US007918713B2

(12) United States Patent
Mandel et al.

(10) Patent No.: US 7,918,713 B2
(45) Date of Patent: Apr. 5, 2011

(54) TRIBOLOGICAL SURFACE AND LAPPING METHOD AND SYSTEM THEREFOR

(75) Inventors: Kostia Mandel, Netanya (IL); Boris Shamshidov, Kiryat Chayim (IL); Bela Shteinvas, Ashkelon (IL); Semyon Melamed, Kiryat-Yam (IL)

(73) Assignee: Frisco Ltd., Tirat Hakarhel (IL)

( * ) Notice: Subject to any disclaimer, the term of this patent is extended or adjusted under 35 U.S.C. 154(b) by 1121 days.

(21) Appl. No.: 11/651,479

(22) Filed: Jan. 10, 2007

(65) Prior Publication Data

US 2010/0255762 A1 Oct. 7, 2010

(51) Int. Cl.
*B24B 1/00* (2006.01)

(52) U.S. Cl. ..... 451/37; 451/56; 451/57; 451/59

(58) Field of Classification Search ..... 451/36, 451/162, 108, 114, 56, 57, 59, 104, 164, 451/37; 29/898.1, 898.13
See application file for complete search history.

(56) References Cited

U.S. PATENT DOCUMENTS

| | | | | |
|---|---|---|---|---|
| 7,134,939 | B2 * | 11/2006 | Shamshidov et al. | 451/36 |
| 7,578,724 | B2 * | 8/2009 | Shteinvas et al. | 451/36 |
| 2009/0227183 | A1 * | 9/2009 | Shamshidov et al. | 451/36 |

* cited by examiner

*Primary Examiner* — Maurina Rachuba
(74) *Attorney, Agent, or Firm* — Mark M. Friedman

(57) ABSTRACT

A conditioning process including the steps of: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface, and (ii) incorporate organic particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface.

18 Claims, 28 Drawing Sheets

FIG. 2A PRIOR ART
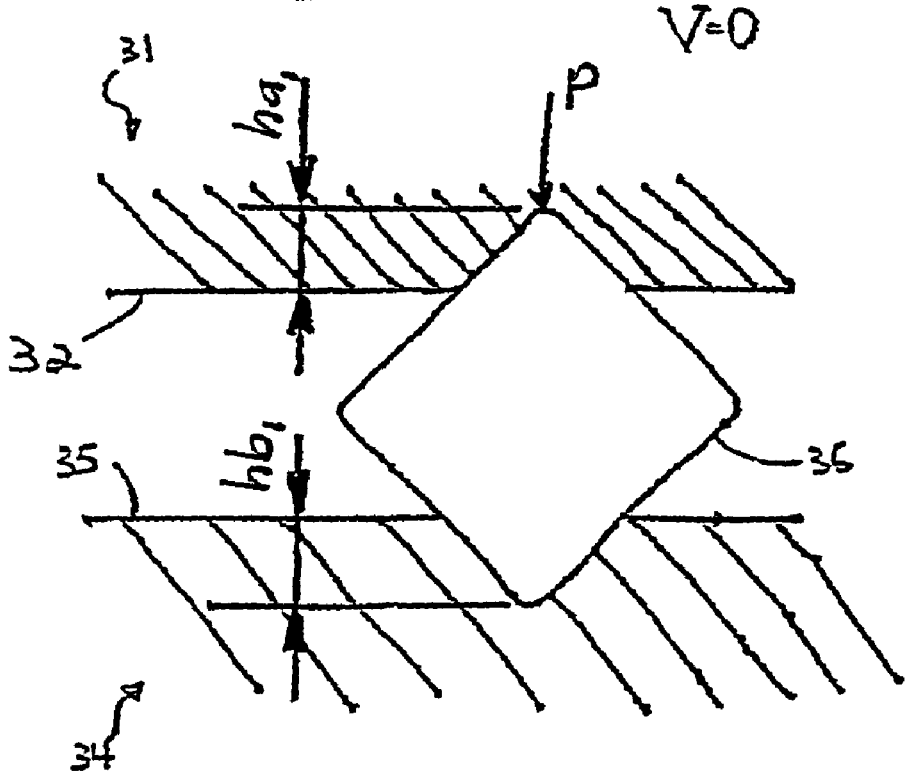
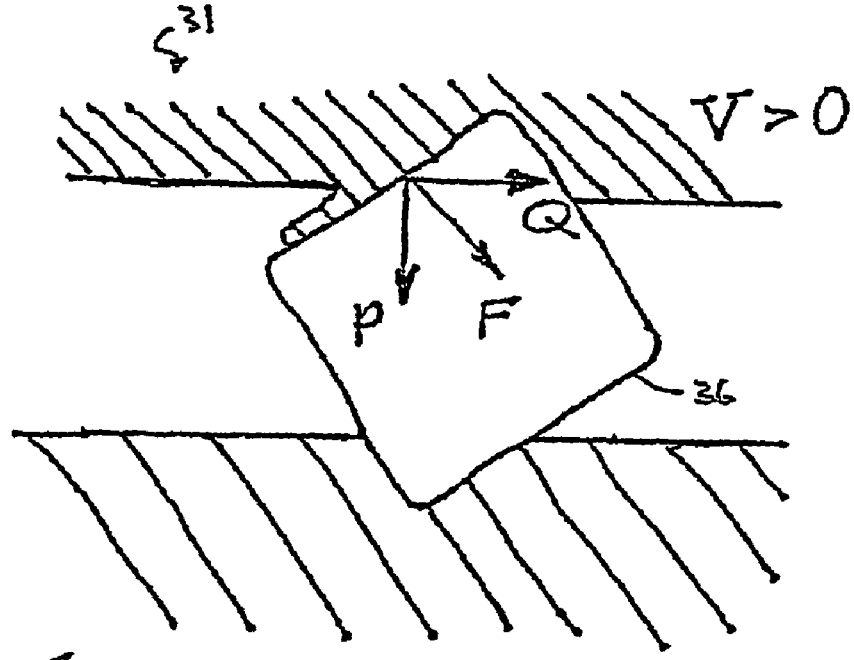
FIG. 2B PRIOR ART

FIG. 5
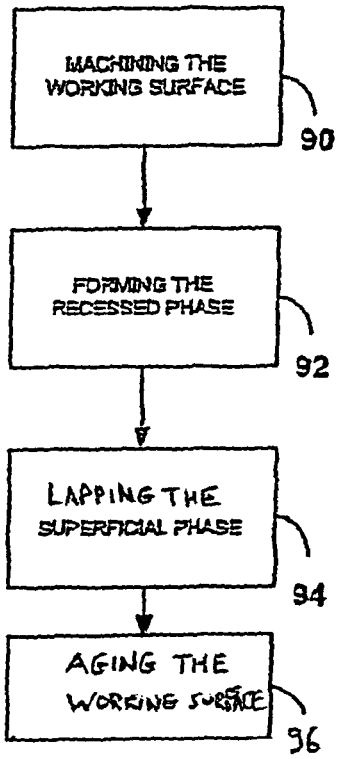
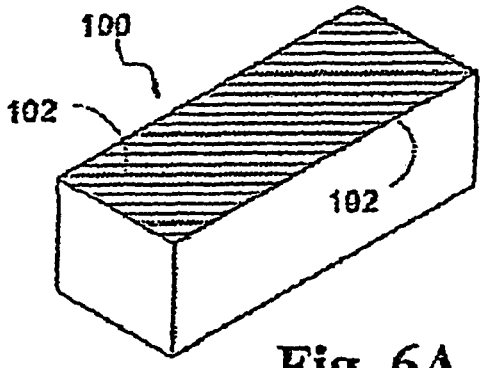
Fig. 6A
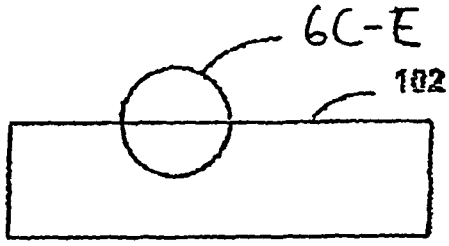
Fig. 6B

FIG. 8C(i)
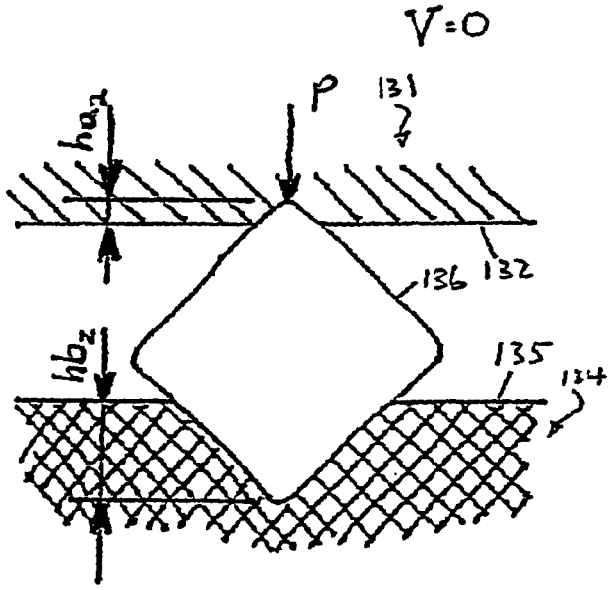
FIG. 8C(ii)
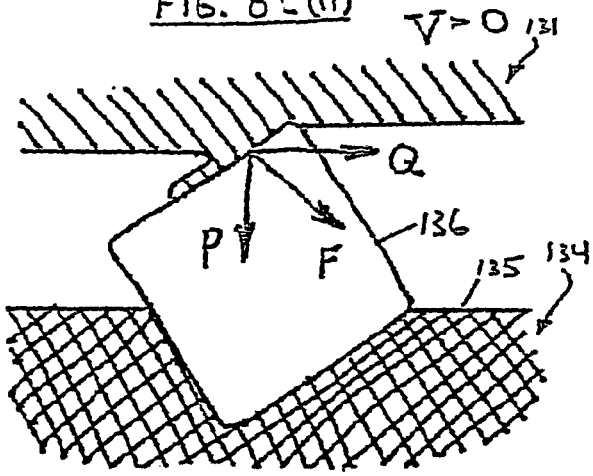
FIG. 8C(iii)
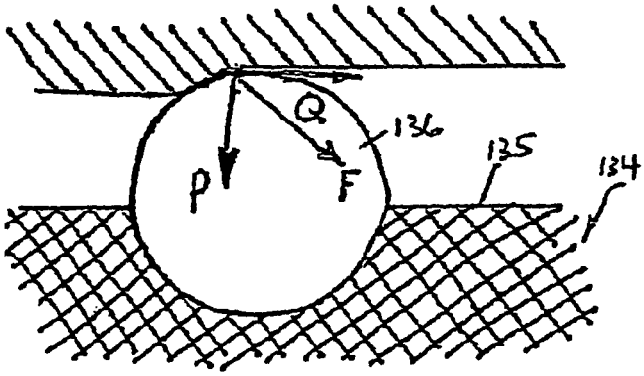

PRIOR ART (a) Dodecanedioic acid (b) Lauric acid (c) Stearic acid

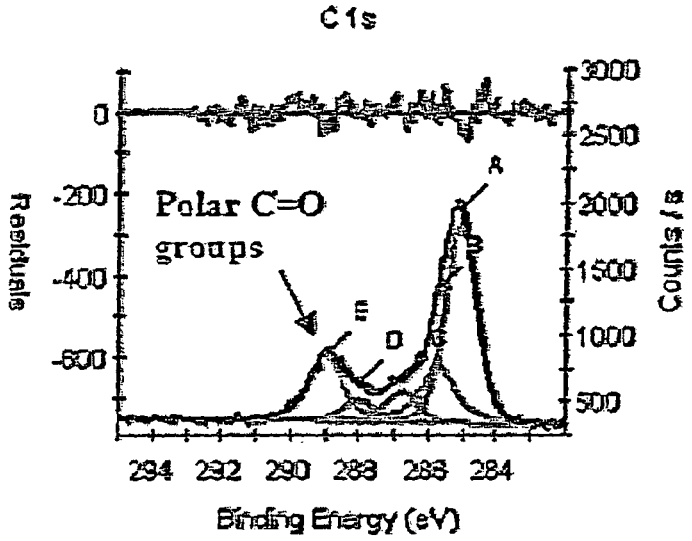
FIGURE
14A
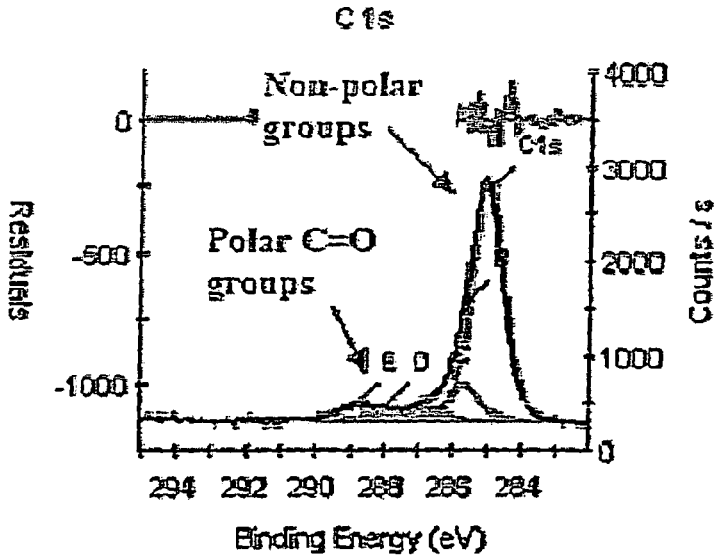
PRIOR ART
FIGURE
14B

TRIBOLOGICAL SURFACE AND LAPPING METHOD AND SYSTEM THEREFOR

FIELD AND BACKGROUND OF THE INVENTION

The present invention relates to improved metal tribological surfaces, and to lapping methods and systems for producing such surfaces.

In order to reduce friction and wear in mechanically interacting surfaces, a lubricant is introduced to the zone of interaction. As depicted schematically in FIG. 1A, under ideal lubricating conditions, the lubricant film 20 between opposing surfaces 32 and 34, moving at a relative velocity V, forms an intact layer which permits the moving surfaces to interact with the lubricant. Under such conditions, no contact between surfaces 32 and 34 occurs at all, and the lubricant layer is said to carry a load P that exists between the opposing surfaces. If the supply of lubricant is insufficient, a reduction in the effectivity of the lubrication ensues, which allows surface-to-surface interactions to occur.

As shown schematically in FIG. 1B, below a certain level of lubricant supply, the distance between opposing, relatively moving surfaces 32 and 34 diminishes because of load P, such that surface asperities, i.e., peaks of surface material protruding from the surfaces, may interact. Thus, for example, an asperity 36 of surface 34 can physically contact and interact with an asperity 38 of surface 32. In an extreme condition, the asperities of surfaces 32 and 34 carry all of the load existing between the interacting surfaces. In this condition, often referred to as boundary lubrication, the lubricant is ineffective and the friction and wear are high.

Grinding and lapping are conventional methods of improving surface roughness and for producing working surfaces for, inter alia, various tribological applications. FIGS. 2A and 2B schematically illustrate a working surface being conditioned in a conventional lapping process. In FIG. 2A, a working surface 32 of a workpiece 31 faces a contact surface 35 of lapping tool 34. An abrasive paste containing abrasive particles, of which is illustrated a typical abrasive particle 36, is disposed between working surface 32 and contact surface 35. Contact surface 35 of lapping tool 34 is made of a material having a lower hardness with respect to working surface 32. The composition and size distribution of the abrasive particles are selected so as to readily wear down working surface 32 according to plan, such as reducing surface roughness so as to achieve a pre-determined finish.

A load is exerted in a substantially normal direction to surfaces 32 and 35, causing abrasive particle 36 to penetrate working surface 32 and contact surface 35, and resulting in a pressure P being exerted on a section of abrasive particle 36 that is embedded in working surface 32. The penetration depth of abrasive particle 36 into working surface 32 is designated by $h_{a1}$; the penetration depth of abrasive particle 36 into contact surface 35 is designated by $h_{b1}$. Generally, abrasive particle 36 penetrates into lapping tool 34 to a greater extent than the penetration into workpiece 31, such that $h_{b1} \gg h_{a1}$.

In FIG. 2B, workpiece 31 and lapping tool 34 are made to move in a relative velocity V. The pressure P, and relative velocity V of workpiece 31 and lapping tool 34, are of a magnitude such that abrasive particle 36, acting like a knife, gouges out a chip of surface material from workpiece 31.

At low relative velocities, abrasive particle 36 is substantially stationary. Typically, however, and as shown in FIG. 2B, relative velocity V is selected such that a corresponding shear force Q is large. Because the material of lapping tool 34 that is in contact with abrasive particle 36 is substantially unyielding (i.e., of low elasticity) with respect to the particles in the abrasive paste, these particles are usually ground up quite quickly, such that the abrasive paste must be replenished frequently.

In the known art, grinding, lapping, polishing and cutting are carried out on materials such as metals, ceramics, glass, plastic, wood and the like, using bonded abrasives such as grinding wheels, coated abrasives, loose abrasives and abrasive cutting tools. Abrasive particles, the cutting tools of the abrasive process, are naturally occurring or synthetic materials which are generally much harder than the materials which they cut. The most commonly used abrasives in bonded, coated and loose abrasive applications are garnet, alpha alumina, silicon carbide, boron carbide, cubic boron nitride, and diamond. The relative hardness of the materials can be seen from Table 1:

TABLE 1

| Material | Knoop Hardness Number |
|---|---|
| garnet | 1360 |
| alpha-alumina | 2100 |
| silicon carbide | 2480 |
| boron carbide | 2750 |
| cubic boron nitride | 4500 |
| diamond (monocrystalline) | 7000 |

The choice of abrasive is normally dictated by economics, finish desired, and the material being abraded. The above-provided list of abrasive materials is in order of increasing hardness, but is also, coincidentally, in order of increasing cost, with garnet being the least expensive abrasive material and diamond the most expensive.

Generally, a soft abrasive is selected to abrade a soft material and a hard abrasive to abrade harder types of materials in view of the cost of the various abrasive materials. There are, of course, exceptions such as very gummy materials where the harder materials actually cut more efficiently. Furthermore, the harder the abrasive grain, the more material it will remove per unit volume or weight of abrasive. Super-abrasive materials include diamond and cubic boron nitride, both of which are used in a wide variety of applications.

Conventional lapping methods and systems generally have several distinct deficiencies, including:

- The contact surface of the lapping tool is eventually consumed by the abrasive material, requiring replacement. In some typical applications, the contact surface of the lapping tool is replaced after approximately 50 workpieces have been processed.
- The lapping processing must generally be performed in several discrete lapping stages, each stage using an abrasive paste having different physical properties.
- Sensitivity to the properties of the abrasive paste, including paste formulation, hardness of the abrasive particles, and particle size distribution (PSD) of the abrasive particles.
- Sensitivity to various processing parameters in the lapping process.

Various improvements to these conventional lapping methods and systems have been disclosed in U.S. Pat. No. 7,134,939 to Shamshidov et al. Additional improvements have been disclosed in an as yet unpublished U.S. patent application Ser. No. 11/287,306 to Shteinvas et al.

These advancements notwithstanding, there is a recognized need for, and it would be highly advantageous to have workpieces and tribological systems having metal working surfaces that exhibit improved tribological properties. It would be of further advantage to have a lapping method and system that overcome various deficiencies of the known lapping technologies, and that produce such improved metal working surfaces.

SUMMARY OF THE INVENTION

According to the teachings of the present invention there is provided a tribological system including: a tribological workpiece having a working surface adapted for moving relative to a counter-surface in a presence of a lubricant, in a load-bearing environment, the working surface for disposing generally opposite the counter-surface, the working surface having: (i) a metal surface layer; (ii) a plurality of organic particles incorporated in the metal surface layer, and (iii) a plurality of inorganic particles incorporated in the working surface, the inorganic particles having a Mohs hardness of at least 8.

According to another aspect of the present invention there is provided a tribological system including: a tribological workpiece having a working surface adapted for moving relative to a counter-surface in a presence of a lubricant, in a load-bearing environment, the working surface for disposing generally opposite the counter-surface, the working surface having: (i) a metal surface layer; (ii) a plurality of organic particles incorporated in the metal surface layer, and (iii) a plurality of inorganic particles incorporated in the working surface, the inorganic particles having a Mohs hardness of at least 8, wherein a combined coverage density of the organic particles and the inorganic particles on the working surface is at least 1%.

According to yet another aspect of the present invention there is provided a tribological system including: a tribological workpiece having a working surface adapted for moving relative to a counter-surface in a presence of a lubricant, in a load-bearing environment, the working surface for disposing generally opposite the counter-surface, the working surface having: (i) a metal surface layer; (ii) a plurality of organic particles bonded to the metal surface layer, and (iii) a plurality of inorganic particles incorporated in the working surface, the inorganic particles having a Mohs hardness of at least 8, wherein the inorganic particles have a population density of at least 10,000 particles per square millimeter.

According to further features in the described preferred embodiments, the inorganic particles are selected from the group of abrasive particles consisting of corundum, alumina, silicon carbide, and boron carbide.

According to still further features in the described preferred embodiments, the inorganic particles include alumina particles.

According to still further features in the described preferred embodiments, the alumina particles include fused alumina particles.

According to still further features in the described preferred embodiments, the working surface is a steel.

According to still further features in the described preferred embodiments, the metal working surface has a Rockwell C hardness of at least 20.

According to still further features in the described preferred embodiments, the metal working surface has a Rockwell C hardness of at least 50.

According to still further features in the described preferred embodiments, the inorganic particles have a population density of at least 10,000 particles per square millimeter.

According to still further features in the described preferred embodiments, the inorganic particles have a population density of at least 50,000 particles per square millimeter.

According to still further features in the described preferred embodiments, the organic particles are intimately bonded to the metal surface layer.

According to still further features in the described preferred embodiments, the organic particles are sufficiently bonded to the metal surface layer so as to remain incorporated in the metal surface layer after subjection to a vacuum of 10−10 torr for five minutes.

According to still further features in the described preferred embodiments, at least a portion of the inorganic particles are incorporated in the organic particles.

According to still further features in the described preferred embodiments, at least a portion of the organic particles form a nanolayer on the working surface.

According to still further features in the described preferred embodiments, at least a portion of the inorganic particles are incorporated in the nanolayer on the working surface.

According to still further features in the described preferred embodiments, at least a portion of the inorganic particles is at least partially covered by the organic particles.

According to still further features in the described preferred embodiments, at least a portion of the inorganic particles is at least partially covered by the nanolayer.

According to still further features in the described preferred embodiments, at least a portion of the inorganic particles is completely covered by the nanolayer.

According to still further features in the described preferred embodiments, the inorganic particles have a Mohs hardness of at least 8.5.

According to still further features in the described preferred embodiments, the organic particles have a coverage density of at least 0.1%.

According to still further features in the described preferred embodiments, the inorganic particles have a coverage density of at least 0.1%.

According to still further features in the described preferred embodiments, the organic particles have a coverage density of at least 0.1%, the inorganic particles have a coverage density of at least 0.1%, and a combined coverage density of the organic particles and the inorganic particles is at least 1%.

According to still further features in the described preferred embodiments, the organic particles and the inorganic particles have a combined coverage density of at least 1%.

According to still further features in the described preferred embodiments, within an area having the population density of at least 10,000 particles per square millimeter, at least 90% of the inorganic particles have a diameter of less than 1000 nanometers.

According to still further features in the described preferred embodiments, at least 90% of the inorganic particles have a diameter of less than 300 nanometers.

According to still further features in the described preferred embodiments, at least 50% of the inorganic particles have a diameter of less than 100 nanometers.

According to still further features in the described preferred embodiments, within an area having the above-referenced coverage density, at least 90% of the inorganic particles have a diameter of less than 1000 nanometers.

According to still further features in the described preferred embodiments, at least 90% of the inorganic particles have a diameter of less than 300 nanometers.

According to still further features in the described preferred embodiments, at least 50% of the inorganic particles have a diameter of less than 100 nanometers.

According to still further features in the described preferred embodiments, the metal surface layer includes a plurality of recessed microstructures.

According to still further features in the described preferred embodiments, the working surface includes at least 0.5% iron, by weight.

According to still further features in the described preferred embodiments, the tribological system further includes the counter-surface, the lubricant, and at least one mechanism, associated with at least one of the working surface and the second surface, for applying a relative motion between the surfaces, and for exerting a load on the surfaces.

According to yet another aspect of the present invention there is provided a conditioning process including the steps of: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface, and (ii) incorporate organic particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface.

According to yet another aspect of the present invention there is provided a conditioning process including the steps of: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface or the contact surface, and (ii) incorporate organic particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface, and wherein the treating of the workpiece further includes aging the modified metal working surface such that the organic particles are incorporated in the metal working surface.

According to yet another aspect of the present invention there is provided a conditioning process including the steps of: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface and/or the contact surface, and (ii) incorporate abrasive particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface, and wherein the abrasive particles have a Mohs hardness of at least 8.

According to still further features in the described preferred embodiments, the treating further includes aging the modified metal working surface such that the organic particles are incorporated in the metal working surface.

According to still further features in the described preferred embodiments, the aging is effected in an oxygen-rich environment.

According to still further features in the described preferred embodiments, the treating further includes aging the modified metal working surface such that the organic particles intimately bond to the metal working surface.

According to still further features in the described preferred embodiments, the conditioning process further includes the step of: (c) producing at least one recessed microstructure in the metal working surface.

According to still further features in the described preferred embodiments, the contact surface has a Shore D hardness within a range of 60 to 90.

According to still further features in the described preferred embodiments, the contact surface has a Shore D hardness within a range of 65 to 90, and wherein the impact resistance is within a range of 4 to 12 $kJ/m^2$.

According to still further features in the described preferred embodiments, the impact resistance is within a range of 5 to 8 $kJ/m^2$.

According to still further features in the described preferred embodiments, the Shore D hardness is within a range of 65 to 82.

According to still further features in the described preferred embodiments, the Shore D hardness is within a range of 70-80.

According to still further features in the described preferred embodiments, the organic particles are derived from the organic material on the contact surface.

According to still further features in the described preferred embodiments, the treating is effected so as to incorporate at least a portion of the abrasive particles in the working surface.

According to still further features in the described preferred embodiments, the workpiece has the modified working surface, prepared according to the above-described processes.

According to still further features in the described preferred embodiments, at least a portion of the organic particles is derived from the organic, polymeric material on the contact surface.

According to still further features in the described preferred embodiments, the aging is performed so as to increase a ratio of polar bonds to non-polar bonds in the working surface.

According to yet another aspect of the present invention there is provided a method of operating a tribological system including the steps of: (a) providing a workpiece having a tribological working surface, the working surface including: (i) a metal surface layer; (ii) a plurality of organic particles incorporated in the metal surface layer, and (iii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load between the working surface and the counter-surface, and (f) applying the relative motion between the working surface and the counter-surface.

According to yet another aspect of the present invention there is provided a method of operating a tribological system including the steps of: (a) providing a workpiece having a tribological working surface, the working surface including: (i) a metal surface layer; (ii) a plurality of organic particles incorporated in the metal surface layer, and (iii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load between the working surface and the counter-surface, and (f) applying the relative motion between the working surface and the counter-surface, wherein the organic particles and the inorganic particles have a combined coverage density of at least 0.5%.

According to yet another aspect of the present invention there is provided a method of operating a tribological system including the steps of: (a) providing a workpiece having a tribological working surface, the working surface including: (i) a metal surface layer; (ii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load between the working surface and the counter-surface, and (f) applying the relative motion between the working surface and the counter-surface, wherein the inorganic particles have a population density of at least 10,000 particles per square millimeter.

According to still further features in the described preferred embodiments, the tribological system is disposed in an engine.

According to still further features in the described preferred embodiments, the tribological system is disposed in an internal combustion engine.

According to yet another aspect of the present invention there is provided a mechanical system for lapping a metal working surface, the system including: (a) a workpiece having the metal working surface; (b) a lapping tool having a contact surface, the contact surface for disposing generally opposite the working surface, the contact surface including an organic, polymeric material; (c) a plurality of particles, including abrasive particles, the abrasive particles for disposing between the contact surface and the working surface, and (d) a mechanism, associated with at least one of the working surface and the contact surface, for applying a relative motion between the contact surface and the metal working surface, and for exerting a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of nanoparticles into the metal working surface.

According to yet another aspect of the present invention there is provided a mechanical system for lapping a metal working surface, the system including: (a) a workpiece having the metal working surface; (b) a lapping tool having a contact surface, the contact surface for disposing generally opposite the working surface, the contact surface including an organic, polymeric material; (c) a plurality of particles, including abrasive particles, the abrasive particles for disposing between the contact surface and the working surface, and (d) a mechanism, associated with at least one of the working surface and the contact surface, for applying a relative motion between the contact surface and the metal working surface, and for exerting a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8.

According to still further features in the described preferred embodiments, the contact surface and the mechanism are further designed and configured, and the plurality of particles is selected, such that the incorporation provides an organic nanolayer intimately bonded to at least a portion of the metal working surface.

According to still further features in the described preferred embodiments, the contact surface and the mechanism are further designed and configured, and the plurality of particles is selected, such that upon activation of the mechanism, the relative motion under the load effects: (iii) incorporation of a portion of the abrasive particles into the metal working surface.

According to still further features in the described preferred embodiments, the contact surface and the mechanism are further designed and configured, and the plurality of particles is selected, such that upon activation of the mechanism, the relative motion under the load effects: (iii) incorporation of a portion of the abrasive particles into the organic nanolayer.

According to still further features in the described preferred embodiments, the contact surface is disposed on a lapping tool.

According to still further features in the described preferred embodiments, the lapping tool has a leading device associated therewith, the leading device for effecting an engagement of the lapping tool.

According to still further features in the described preferred embodiments, the leading device is associated with the lapping tool so as to provide the lapping tool with at least one degree of freedom of movement with respect to the metal working surface.

According to still further features in the described preferred embodiments, the lapping tool has an internal tube for delivering a working agent from an external supply to a volume between the contact surface and the working surface.

According to still further features in the described preferred embodiments, the organic nanolayer has an average thickness of less than 25 nanometers.

According to still further features in the described preferred embodiments, the organic nanolayer has an average thickness of less than 15 nanometers.

According to still further features in the described preferred embodiments, the organic nanolayer has an average thickness of less than 10 nanometers.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings:

FIGS. 2A and 2B schematically illustrate a working surface being conditioned in a conventional lapping process;

FIG. 5 is a flow chart of the process of conditioning a working surface in accordance with one embodiment of the inventive lapping process;

FIG. 6A is schematic view of an interacting surface of the lapping technology disclosed herein;

FIG. 6B is a schematic description of a side view of the interacting surface of FIG. 6A;

FIG. 8C(i)-(iii) are an additional cross-sectional schematic representation of a working surface being conditioned in the inventive lapping process;

FIGS. 14A and 14B are X-ray Photoelectron Spectroscopy (XPS) spectra (carbon C1s) of the inventive polymer-lapped surface and of the conventionally lapped steel surface, respectfully;

DESCRIPTION OF THE PREFERRED EMBODIMENTS

Figure 1A:
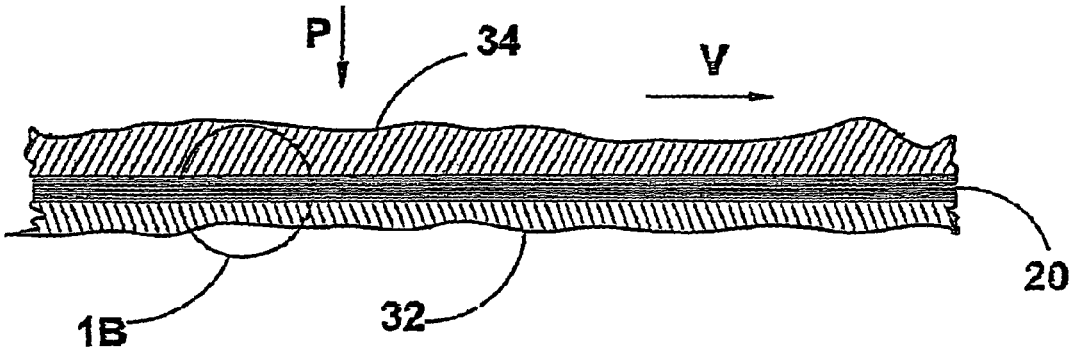
Fig. 1A PRIOR ART
FIG. 1A is a schematic description of the mechanically interacting surfaces having an interposed lubricating layer.

The present invention relates, inter alia, to metal tribological surfaces enhanced with an organic nanolayer, and to lapping methods and systems for producing such surfaces.

The principles and operation of the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

Figure 3A:
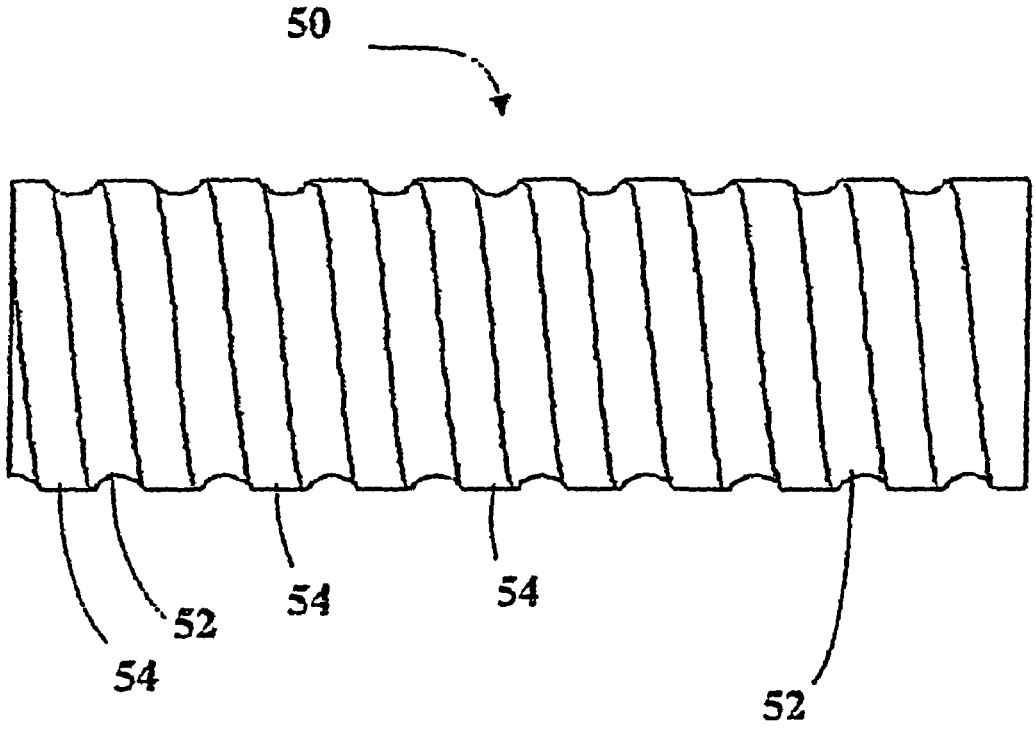
FIG. 3A is a schematic side view of a grooved cylinder in accordance with the inventive lapping process.
Figure 3B:
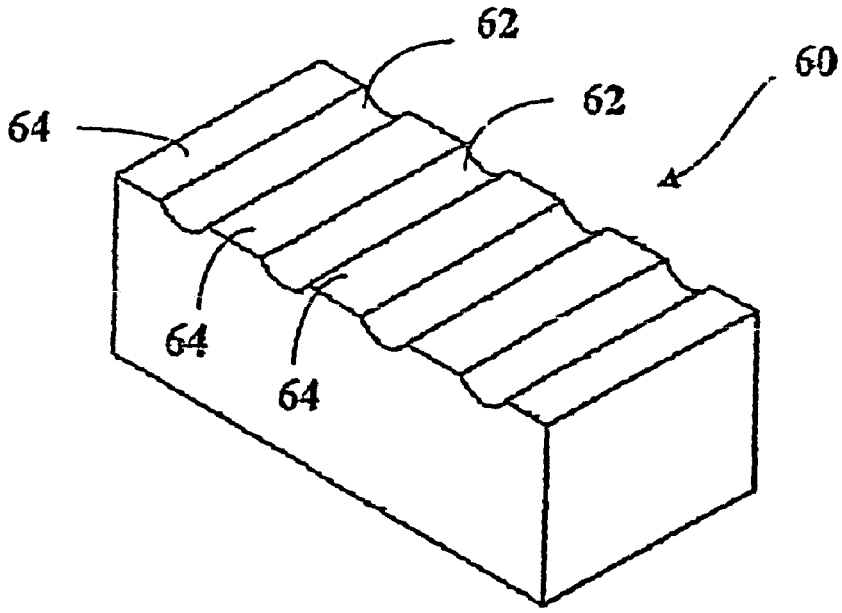
FIG. 3B is a schematic view of a metal plate, the working surface of which is grooved, in accordance with the inventive lapping process.

FIG. 3A is a schematic side view of a cylinder 50 lapped in accordance with the inventive lapping process. Cylinder 50 has one or more grooves, such as helical groove 52, engraved on the surface. Typically, such grooves have a maximum depth of about 5-30 microns, and a width of about 100-1000 microns. The remainder of the original surface is one or more plateaus, such as substantially flat regions 54. FIG. 3B is a schematic representation of a metal workpiece 60 that has been processed by the inventive lapping process described hereinbelow. The working surface includes grooves 62, and alternate, substantially flat regions 64.

Figure 4A:
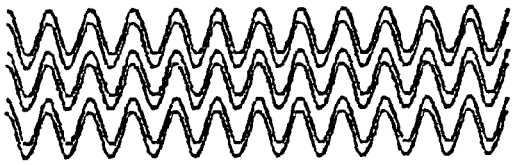
FIG. 4A is a pattern of dense sinusoidal grooving, in accordance with an embodiment of the inventive lapping process.
Figure 4C:
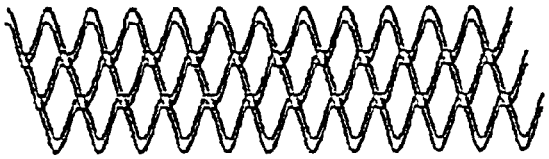
FIG. 4C is a sinusoidal pattern of grooving, containing overlapping waves, in accordance with an embodiment of the inventive lapping process.
Figure 4B:
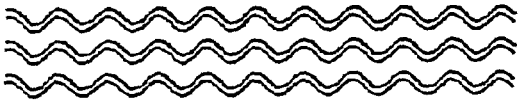
FIG. 4B is a pattern of sinusoidal grooving, in accordance with an embodiment of the inventive lapping process.
Figure 4D:
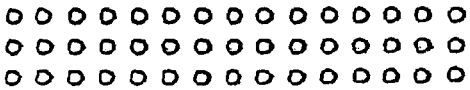
FIG. 4D is a pitted pattern of grooving in accordance with an embodiment of the inventive lapping process.

In FIGS. 4A-D are provided exemplary, schematic patterns of recessed microstructures, such as microgrooves, which are suitable for the structural aspects of embodiments of the present invention. FIGS. 4A-B show sinusoidal patterns of varying density; FIG. 4C shows a sinusoidal pattern containing overlapping sinuses, and FIG. 4D shows a pitted pattern. The diversity of optional patterns is very large, and the examples given above constitute only a representative handful.

In a preferred process for conditioning the working surface, described schematically in FIG. 5, the working surface is machined by abrading and/or lapping (step 90) so as to obtain a high degree of flatness and surface finish. In step 92, an optional recessed zone is formed, and in step 94, the superficial zone of the working surface undergoes lapping. The surface is preferably aged (step 96), as will be explained hereinbelow, to obtain the inventive working surface.

In those embodiments in which the recessed zone is desirable, the working surface may be micro-structured to obtain a plurality of recesses. This can be achieved by various methods known in the art, including mechanical cutting, laser engraving, and chemical etching. Methods for producing regular microstructures in mechanical parts is taught by M. Levitin and B. Shamshidov in "A Disc on Flat Wear Test Under Starved Lubrication", Tribotest Journal 4-2, December 1997, (4), 159, the contents of which are incorporated by reference for all purposes as if fully set forth herein.

Lapping of the superficial zone has been found to achieve a very good flatness rating, and a superior finish. The lapping technique uses a free-flowing abrasive material, as compared to grinding, which uses fixed abrasives.

Figure 6C:
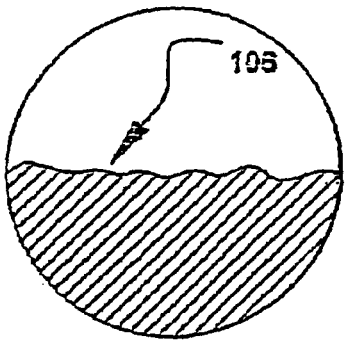
FIG. 6C is a cross-sectional schematic description of the surface of FIG. 6B.
Figure 6D:
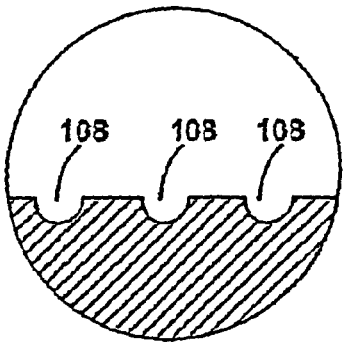
FIG. 6D is a cross-sectional schematic description of the surface of FIG. 6C, after micro-grooving.
Figure 6E:
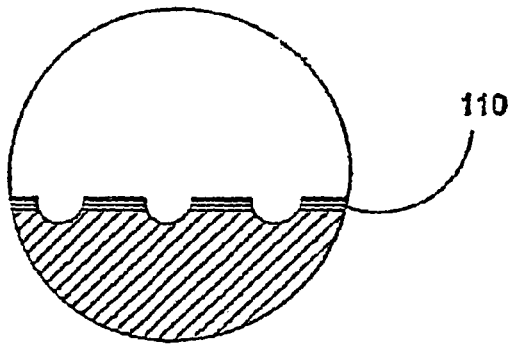
FIG. 6E is a cross-sectional schematic description of the micro-grooved surface of FIG. 6D, after undergoing the inventive lapping process.

FIG. 6A describes schematically an interacting surface 100, a working surface 102 of which is to be processed in accordance with an embodiment of the invention. A schematic sectional view of the surface is shown in FIG. 6B, indicating the position of an enlarged view of the cross-section shown in FIGS. 6C-E. In FIG. 6C, a machined surface 106 is shown. In FIG. 6D, surface 106 is shown after optional microgrooves or recessed microstructures 108 have been formed. In FIG. 6E, the working surface has been leveled and transformed by the inventive lapping process. A new plastically deformed region 110, which will be discussed in greater detail hereinbelow, has formed on the superficial zone.

Figure 7B:
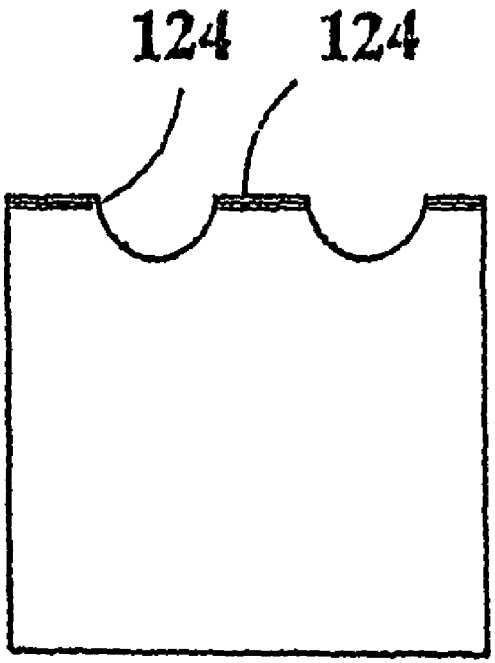
FIG. 7B is a cross-sectional schematic description of the surface of FIG. 7A, after undergoing the inventive lapping process.
Figure 7A:
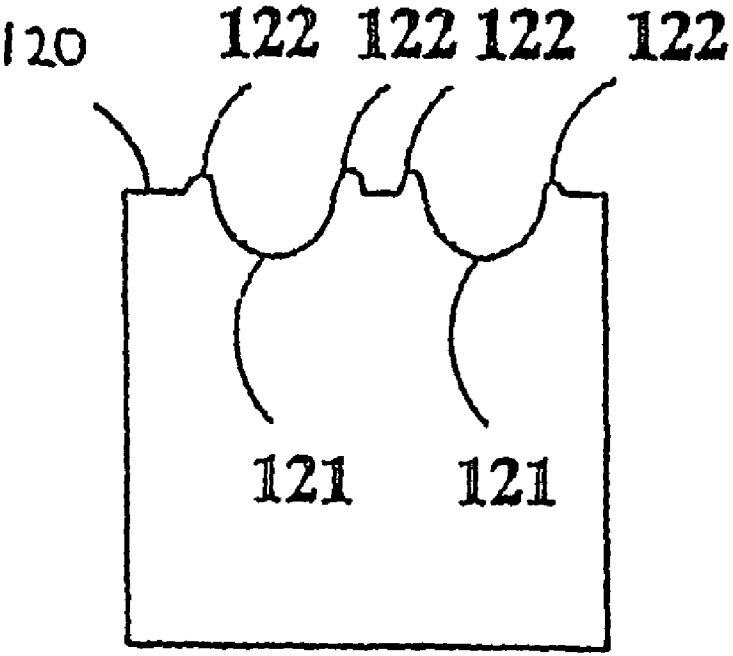
FIG. 7A is a cross-sectional schematic description of the working surface, after micro-grooving, the micro-grooves being surrounded by bulges.

The lapping step preferably succeeds the microgrooving step, because in forming the recessed microstructures on the surface, bulging of the surface around the microstructures is common. The bulges may appear even if the structural changes are effected by laser-cutting. This is illustrated schematically in FIGS. 7A-B, to which reference is now made. In FIG. 7A, recessed microstructures or microgrooves 121 have been formed in working surface 120. Around the edges of recessed microstructures 121 are disposed bulges 122, produced in the formation of microstructures 121. After the inventive lapping process, the bulges are leveled, and a plastically deformed region 124 is produced (see FIG. 7B) near the surface of working surface 120.

Lapping is the preferred mechanical finishing method for obtaining the characteristics of the working surface of the mechanical element in accordance with the present invention. The lapping is performed using a lapping tool, the surface of which is softer than the working surface of the processed mechanical part, and a paste containing abrasive grit. The paste may be a conventional paste used in conventional lapping processes. In order to be effective, the abrasive grit must be much harder than the face of the lapping tool, and harder than the processed working surface. Aluminum oxide has been found to be a particularly suitable abrasive material for a variety of lapping surfaces and working surfaces, in accordance with the invention.

Figure 8A:
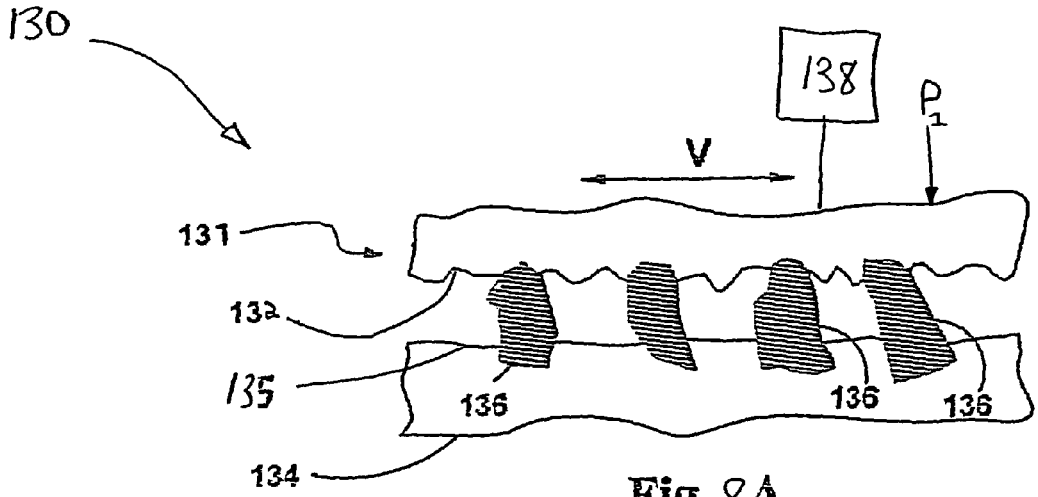
FIG. 8A is a cross-sectional schematic description of a lapping tool—working surface interface prior to lapping, in accordance with the invention.
Figure 8B:
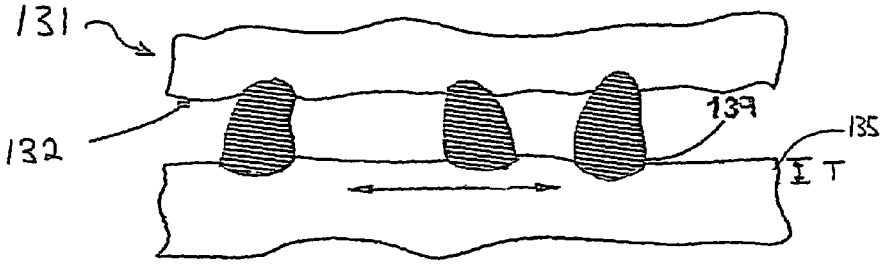
FIG. 8B is a cross-sectional schematic description of the lapping tool—working surface condition after lapping has progressed, in accordance with the invention.

FIGS. 8A-B schematically present progressive steps in the inventive lapping process, in which the conditioning of the working surface is promoted. The initial condition of one aspect of the inventive lapping system 130 is shown schematically in FIG. 8A. The irregular topography of a working surface 132 (disposed on a workpiece 131) faces a lapping tool 134 and is separated by an irregular distance therefrom. Abrasive particles 136 are partially embedded in contact surface 135 of lapping tool 134, and to a lesser extent, in working surface 132. Working surface 132 and contact surface 135 are made to move in a relative motion by mechanism 138. This motion has an instantaneous magnitude V. Mechanism 138 also exerts a load, or a pressure $P_1$, that is substantially normal to contact surface 135 and working surface 132.

Those skilled in the art will appreciate that mechanism 138 may be chosen from various known and commercially available mechanisms for use in conjunction with lapping systems.

In FIG. 8B, some lapping action has taken place, causing working surface 132 to become less irregular. As a result of the relative movement between the surfaces, the abrasive particles, such as abrasive particle 139, are now rounded to some extent, losing some of their sharp edges in the course of rubbing against the surfaces.

While initially, abrasive particles 136 penetrate into working surface 132 and gouge out material therefrom, as the process continues, and the abrasive particles become rounded, substantially no additional stock is removed from the processed part. Instead, the lapping movement effects a plastic deformation in working surface 132 of workpiece 131, so as to increase the micro-hardness of working surface 132.

FIGS. 8C (i)-(iii) are an additional schematic representation of a working surface being conditioned in a lapping process and system of the present invention. In FIG. 8C(i), a working surface 132 of a workpiece 131 faces a contact surface 135 of lapping tool 134. An abrasive paste containing abrasive particles, of which is illustrated a typical abrasive particle 136, is disposed between working surface 132 and contact surface 135. As in conventional lapping technologies, contact surface 135 of lapping tool 134 is made of a material having a greater wear-resistance and a lower hardness with respect to working surface 132. The composition and size distribution of the abrasive particles are selected so as to readily wear down working surface 132 according to plan, such as reducing surface roughness to a pre-determined roughness.

A load is exerted in a substantially normal direction to surfaces 132 and 135, causing abrasive particle 136 to penetrate working surface 132 and contact surface 135, and resulting in a pressure P being exerted on a section of abrasive particle 136 that is embedded in working surface 132. The penetration depth of abrasive particle 136 into working surface 132 is designated by $h_{a2}$; the penetration depth of abrasive particle 136 into contact surface 135 is designated by $h_{b2}$. Abrasive particle 136 penetrates into lapping tool 134 to a much greater extent than the penetration into workpiece 131, such that $h_{b2} >> h_{a2}$. Significantly, because of the substantial elastic character of the deformation of inventive contact surface 135, the penetration depth of abrasive particle 136 into contact surface 135 is much larger than the penetration depths of identical abrasive particles into metal contact surfaces of typical conventional systems (under the same pressure P), i.e., $$h_{b2} > h_{b1},$$

where $h_{b1}$ is defined in FIG. 1C(i). Consequently, the penetration depth of abrasive particle 136 into working surface 132, $h_{a2}$, is much smaller than the corresponding penetration depth, $h_{a1}$, in such conventional systems, i.e., $$h_{a2} < h_{a1}.$$

In FIG. 8C(ii), workpiece 131 and lapping tool 134 are made to move in a relative velocity V. The pressure P, and relative velocity V of workpiece 131 and lapping tool 134, are of a magnitude such that abrasive particle 136, acting like a cutting tool, gouges out a chip of surface material from workpiece 131. This chip is typically much smaller than the chips that are gouged out of the working surfaces conditioned by conventional lapping technologies using cast iron or aluminum contact surfaces.

In FIGS. 8C(ii)-(iii), relative velocity V is selected such that a corresponding shear force Q is large enough, with respect to pressure P, such that the direction of combined force vector F on abrasive particle 136 causes abrasive particle 136 to rotate. During this rotation, the elasticity of lapping tool 134 and contact surface 135 results in less internal strains within abrasive particle 136, with respect to the conventional lapping technologies, such that a typical particle, such as abrasive particle 136, does not shatter, rather, the edges of the surface become rounded. An idealization of this rounding phenomenon is provided schematically in FIG. 8C(iii).

The working surfaces of the present invention have an intrinsic microstructure that influences various macroscopic properties of the surface. Without wishing to be limited by theory, it is believed that the inventive lapping system effects a plastic deformation in the working surface, so as to improve the microstructure of the working surface. One manifestation of the modified microstructure is a greatly increased micro-hardness. Other manifestations of the modified microstructure will be developed hereinbelow.

The mechanical criteria with which the polymeric contact surface should preferably comply include:

1. wear resistance with respect to the abrasive paste used in the lapping process;
2. elastic deformation such that individual abrasive particles protrude into, and are held by, the polymeric surface; as the individual abrasive particles rotate during contact with the working surface, the elastic deformation should enable the particles to be absorbed into the polymeric surface in varying depths, according to the varying pressures exerted between the particles and the working surface. Consequently, the abrasive particles rotate against the working surface and become more rounded with time, instead of undergoing comminution (being ground into a fine powder);
3. the hardness of the polymeric surface should be selected such that the elastic layer does not appreciably break or grind the abrasive powder.

Thus, contact surface 135 of lapping tool 134 (see FIGS. 8A-8B, and FIGS. 8C(i)-8C(iii)) is an organic, polymeric surface. If contact surface 135 is a layer that is mechanically supported (e.g., on a metal backing), surface 135 preferably has a thickness T (see FIG. 9B) of at least 0.5 mm. Alternatively, organic, polymeric contact surface 135 has a thickness T of at least 5 mm and more preferably at least 8-10 mm, such that contact surface 135 is substantially self-supporting.

Figure 9A:
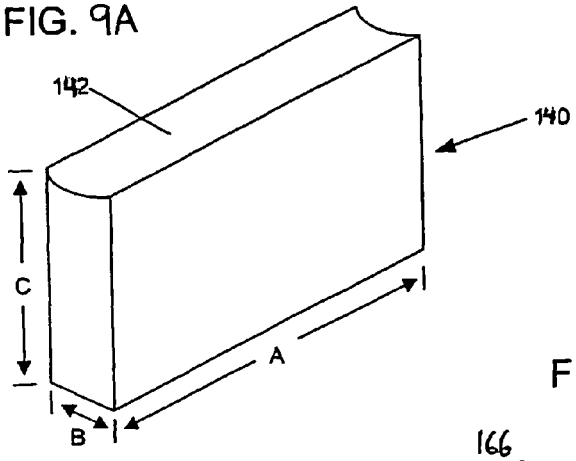
FIGS. 9A and 9C are a schematic perspective view of embodiments of a lapping tool used in conjunction with the present invention.

One embodiment of the lapping tool used in conjunction with the present invention is provided in FIG. 9A. Lapping tool 100 is adapted for lapping an outside diameter of a component, such as a cylinder 300 shown in FIG. 9B. Lapping tool 100 is essentially a cube, a cubic rectangle or a box-shaped device, having a length A, a width B and a height C. Length A may be about twice the length of width B, and height C may be about half of width B. This is designated as a ratio of 2:1:0.5. Length A, width B and height C may also have other dimensions, such as ratios 1:2:1, 0.5:2:3 and others.

The top side of lapping tool 100 includes a working area 102, which may be symmetrically or asymmetrically concave. The radius of the concavity of the working area 102 may be approximately equal to the radius of a cylinder, such as cylinder 300, such that as the lapping treatment is being conducted, a substantial portion of working area 102 (up to the entire surface area of working area 102) may be in contact with an outside surface 302 of cylinder 300. Initially (i.e., prior to contact with outside surface 302), the concavity of working area 102 may have a radius smaller or larger than the radius of cylinder 300. Working area 102 may lack concavity altogether. As the treatment progresses, working area 102 may self-form (or self-align) to an approximate or exact radius of cylinder 300. Alternatively, working area 102 may retain essentially its original shape over the course of treatment of outside surface 302.

In the embodiment of lapping tool 100 described above and shown in FIG. 9A, lapping tool 100 is often made of a single piece of polymeric material.

Figure 9C:
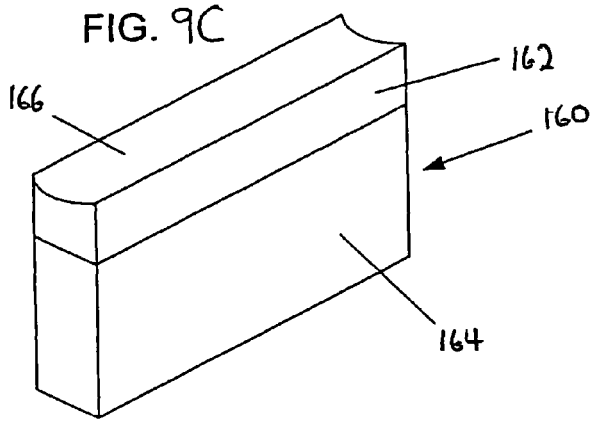

In another embodiment, lapping tool 200, more fully shown in FIG. 9C, may have an external shape essentially similar or identical to that of the embodiment of the lapping tool 100 described in relation to FIG. 9A, but lapping tool 200 may include two or more sub-sections. Each sub-section may be made of similar or different materials. For example, a surface treatment region, such as working area component 202 having a working area 206, may be made of a polymeric material; a supporting or structural component, such as base component 204 may be made of at least one structural or rigid material such as metal, polymer, ceramic, wood and the like. One advantage of forming lapping tool 200 with two or more sub-sections is the relative high cost of some polymeric materials that may be used to shape, form, or otherwise embody (hereinafter referred to as "form") base component 204, compared to the possible cost of other rigid materials that may form working area component 202 or other sub-sections of lapping tool 200. Another advantage may be the functional need to add rigidity and/or support to lapping tool 200; since the polymeric material that forms working area component 202 may be less mechanically-stable compared to other rigid materials, using such rigid materials to form base component 204 may add rigidity and support to the lapping tool, such as those shown at 100 and 200 in FIGS. 9A and 9C, respectively.

Figure 9B:
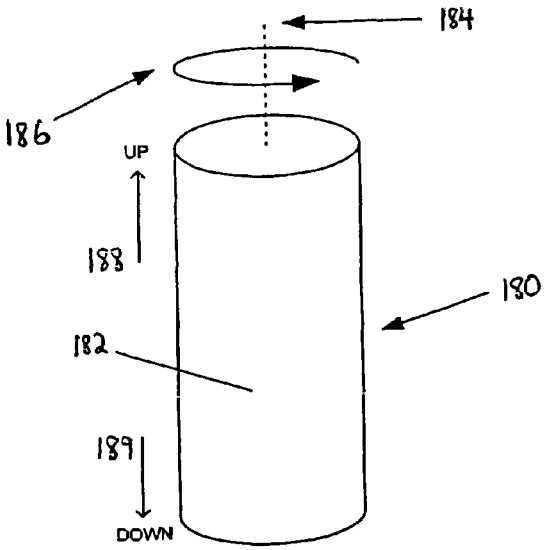
FIG. 9B is an exemplary, schematic perspective view of a cylinder having a working surface, for treating according to the present invention to obtain the inventive modified working surface.
Figure 9F:
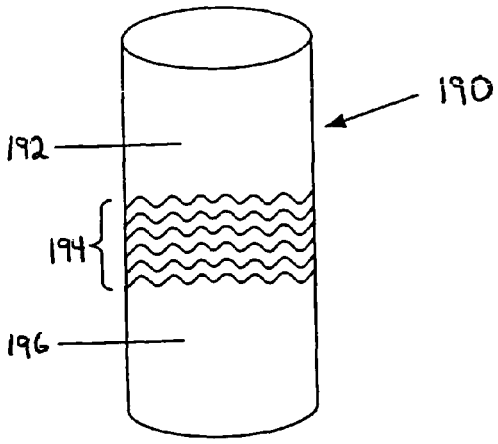
FIG. 9F is an exemplary, schematic perspective view of a cylinder having a working surface with different tribological zones, each zone for treating in a different manner to obtain a particular embodiment of the inventive modified working surface.
Figure 9D:
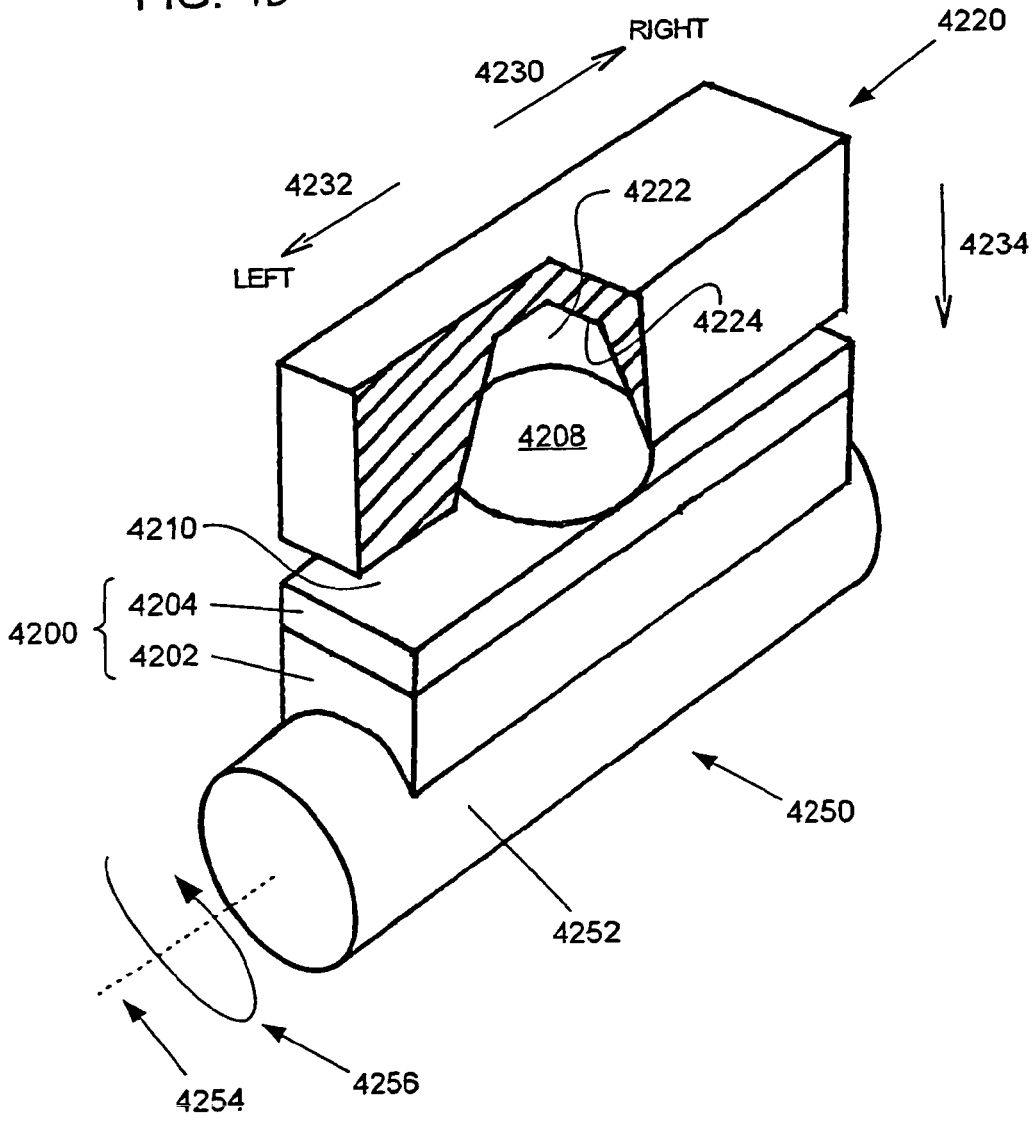
FIG. 9D is an exemplary, perspective view of an embodiment of a lapping tool having a leading device, according to the present invention.

In another embodiment shown in FIG. 9D, a lapping tool, such as lapping tool 4200 (that may include a base component, such as base component 4204, and a working area component, such as working area component 4202), may have an external shape essentially similar to that of lapping tool 200 shown in FIG. 9C, but with an alteration: lapping tool 4200 may have an essentially spherical protrusion, such as protrusion 4208, on top of its base component 4204. Exemplary protrusion 4208 has the shape of essentially a hemisphere, but other protrusions (not shown) may be have other essentially oval or spherical shapes. Exemplary protrusion 4208 may be integrally formed with base component 4204 and located essentially at the center of the surface of base component 4204, but other protrusions (not shown) may be essentially functionally connected or attached to a base component (not shown), and/or positioned differently relative to a base component (not shown).

In addition to a cylinder with a homogenous radius along its entire length or along a desired portion of its length, a lapping tool (not shown) may also be suitable for treating a cylinder which has one or more ridges or one or more grooves (or a combination of one or more ridges and one or more grooves) on its outer surface (not shown). A lapping tool may have one or more grooves or ridges on its working area to functionally fit one or more ridges or grooves, respectively, on the outer surface of the cylinder. A lapping tool may also have a combination of one or more grooves and one or more ridges on its working area that may functionally fit respective grooves and ridges on the outer surface of a cylinder. The term "functionally fit" used above may represent identical or different sizes of the grooves or ridges on the working area of a lapping tool, and ridges and grooves, respectively, on a cylinder. Different sizes may be used, for example, by having a ridge on a working area of a lapping tool that is larger in size than the respective groove on a cylinder. During the treatment process, the ridge(s) on the working area(s) of the lapping tool may wear and fit (or align) itself to the size(s) and/or shape(s) of the groove.

In addition, a lapping tool, such as those shown at 100 and 200 in FIGS. 9A and 9C respectively, may also be suitable for treating devices of various shapes that have one or more portion(s) with an essentially cylindrical outline. The cylindrical outline, as well as cylinder 300, may be hollow, filled or have other attributes associated with the internal volume thereof.

One example of a cylinder that may be suitable for treatment by such lapping tools is a piston pin (or a wrist pin)—a component used extensively in the automotive and other industries. A piston pin may be used for connecting two parts inside an engine—the piston and the connecting rod. A piston pin may be made of steel and/or other rigid materials, and has the shape of essentially a cylinder. For a more detailed explanation of a piston pin, a piston, a connecting rod and other components that may be related, see Anthony E. Schwaller, *Total Automotive Technology* (4th ed. 2005).

During operation of the engine, the piston and the connecting rod move, and friction may occur between at least one of them and the piston pin. Treating the surface of the piston pin using a lapping tool such as lapping tool 100 or lapping tool 200 may reduce that friction.

Other examples of components that may exhibit improved tribological performance after the working surfaces of these components undergo treatment according to the lapping technologies of the present invention, include: poppet valves, hydraulic pistons, sliding bearings (sometimes referred to as "journal bearings" or "friction bearings"), and rollers of roller bearings (sometimes referred to as "non-friction bearings"). More detailed treatments of these mechanical components are available in the literature, including:

Andrew Parr, *Hydraulics and Pneumatics: A Technicians and Engineers Guide* (2nd ed. 1999);

Igor J. Karassik, Joseph P. Messina, Paul Cooper, Charles C. Heald, *Pump Handbook* (3rd ed. 2000);

Michael M. Khonsari, Earl Richard Booser, *Applied Tribology: Bearing Design and Lubrication* (1st ed. 2001);

Avraham Harnoy, *Bearing Design in Machinery* (2002);

Tedric A. Harris, Michael N. Kotzalas, *Rolling Bearing Analysis* (5th ed. 2006), as well as the above-referenced Schwaller reference, all of which are incorporated by reference for all purposes as if fully set forth herein.

Treatment of cylindrical components may be conducted by spinning or rotating a cylinder, such as cylinder 300, around a central axis 304 thereof (for example, in a direction of rotation 306), while essentially simultaneously functionally contacting the working area (such as working areas 102 and 206) with surface 302. The functional contact of the working area with surface 302 may include reciprocating (moving alternately in opposite directions such as up 308 and down 310 along the length of surface 302) the lapping tool along central axis 304 of cylinder 300.

Other treatments may be conducted by a lapping tool 4200 shown in FIG. 9D, in conjunction with a leading device, such as leading device 4220. Leading device 4220 may be a rectangular cube or a box-shaped device, having a recess, such as recess 4222, in a bottom surface thereof. In other embodiments, the leading device (not shown) may be otherwise shaped, given that it has a recess, such as recess 4222, shaped as explained below. Exemplary leading device 4220 is made of metal, but other embodiments may be made of other rigid materials, such as polymer, wood, or the like.

Recess 4222 may essentially have the shape of a cylinder, having a larger diameter at its opening (that appears next to protrusion 4208 in FIG. 9D) and a relatively smaller diameter at its closed side, such as closed side 4224. The shape and size of recess 4222 may essentially correspond to the shape and side of protrusion 4208, such that when leading device 4220 is placed essentially adjacent to lapping tool 4200, protrusion 4208 may essentially functionally contact the internal walls of recess 4222, so as to prevent the bottom surface (not shown) of leading device 4220 from contacting a top surface thereof, such as top surface 4210 of lapping tool 4200. Other embodiments may include a differently shaped recess, given that the recess corresponds to the shape and size of the relevant protrusion, as described above. Similarly, other embodiments may include a differently shaped protrusion, given that the protrusion corresponds to the shape and size of the relevant recess, as described above.

Treatment of cylinders, such as a cylinder 4250 shown in FIG. 9D, using lapping tool 4200 and leading device 4220, may be conducted by placing lapping tool 4200 with a working area thereof (not shown) essentially adjacent to an external surface, such as surface 4252 of cylinder 4250, and then placing leading device 4220 essentially adjacent to top surface 4210, so that protrusion 4208 essentially functionally fits within recess 4222. Pressure may be optionally applied on or by leading device towards lapping tool 4200, for example, in direction 4234. Then, cylinder 4250 may be rotated around its central axis, such as central axis 4245 (for example, in direction of rotation 4256), while the working area (not shown) of lapping tool 4200 essentially functionally contacts surface 4252 of cylinder 4250.

Essentially due to recess 4224 and protrusion 4208, lapping tool 4200 may experience a certain degree of freedom of movement. Such freedom of movement may be advantageous, since it may allow lapping tool 4200 to dynamically alter its position during treatment, to better fit surface 4252 of cylinder 4250.

Furthermore, leading device 4220 (and therefore also lapping tool 4200) may be optionally reciprocated along the length of cylinder 4250 during treatment, for example right 4230 and left 4232.

A paste, a slurry and/or other fluids and/or solids (hereinafter referred to as "working agents") is often used as an intermediate between the working area (such as working area 102 in FIG. 9A) and a surface of a cylinder, such as surfaces 302 and 4252 of cylinders 300 and 4250, respectively. Such working agents may be abrasive, include grain or grit, and/or have some chemical etching properties.

Optionally, a lapping tool may be equipped with one or more tubing systems adapted to deliver one or more working agents to space delimited between the lapping tool working area and the surface of a cylinder or other component. A tubing system (hereinafter referred to as an "internal tubing system") may include one or more tubes and/or bores that pass essentially through the lapping tool, and deliver the working agent to the lapping tool working area through one or more suitably disposed apertures. Alternatively, other tubing systems (hereinafter referred to as "external tubing systems") may include one or more tubes that run essentially externally to the lapping tool, and deliver the working agent to space delimited between the lapping tool working area and the surface of a cylinder, as described hereinabove.

Optionally, a tubing system may include a combination of an internal tubing system and an external tubing system.

Figure 9E:
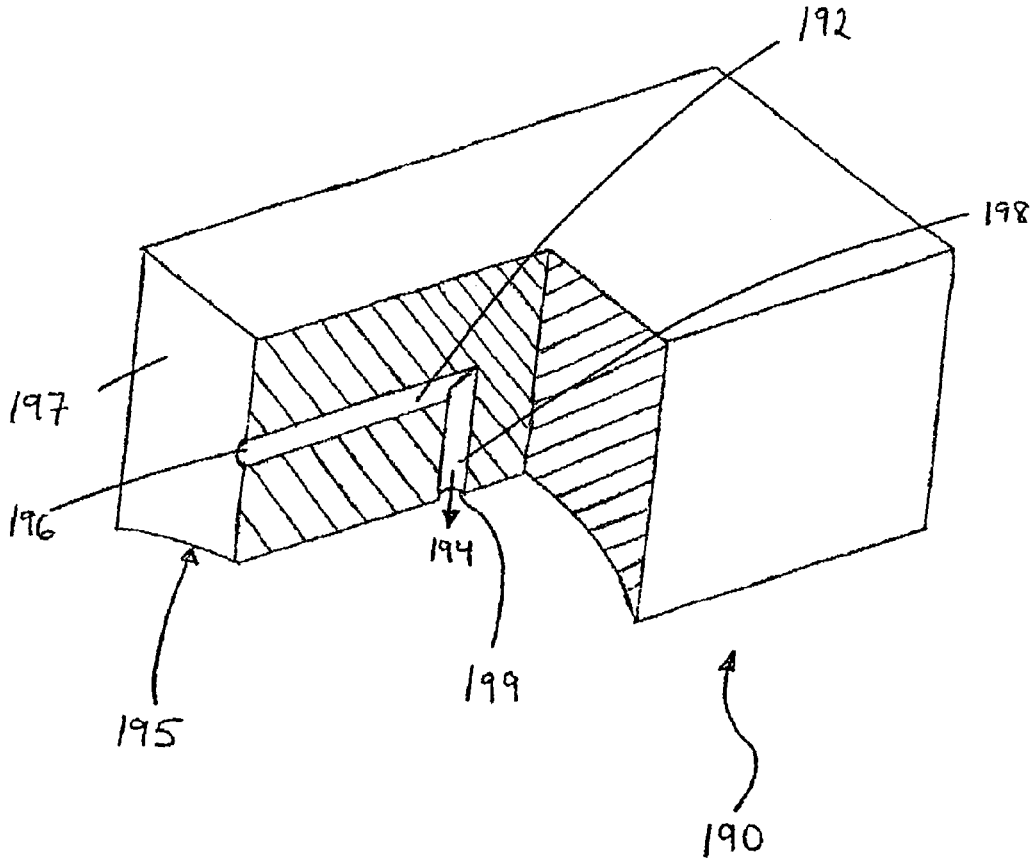
FIG. 9E is an exemplary, perspective, cut-open view of an embodiment of an inventive lapping tool having an internal tubing system for delivering an abrasive paste to the lapping tool working area.

FIG. 9E is an exemplary, perspective, cut-open view of an embodiment of a lapping tool 190 having an internal tubing system including internal tube 192 for delivering a working agent such as an abrasive paste to a lapping tool working space 194, i.e., the space between a contact surface 195 of lapping tool 190 and the working surface of the component (not shown), when the component is oriented so as to effect lapping of the working surface. In the embodiment provided in FIG. 9E, a distal end 196 of internal tube 192 is for receiving the abrasive paste from a source or reservoir, and passes through a side wall 197 of lapping tool 190. A proximal end 198 of internal tube 192 is for discharging the abrasive paste to lapping tool working space 194, via an opening or aperture 199 in contact surface 195.

The working agents may be fed to the tubing system in continuous fashion, at pre-determined intervals, or as otherwise desired. Feeding may be conducted using a pump and/or other means.

In addition to the treatment described above, treatments of different or similar natures may be performed on a surface of a cylinder, such as surfaces 302 and 4252 of cylinders 300 and 4250, respectively, for the purpose of conveying particular tribological properties thereto. Such treatments may be performed on essentially the same area of a surface of a cylinder, such as surfaces 302 and 4252 of cylinders 300 and 4250, respectively, or on essentially distinct areas of it. The treatments can be performed in either essentially simultaneously or essentially discrete fashion.

Some possible additional treatments may include changing the structure of a surface, such as surface 302 of cylinder 300. The structural change may include forming one or more recessed or elevated zones on surface 302 of the cylinder 300. Such recessed or elevated zones may have repeating or non-repeating patterns.

FIG. 9F is an exemplary, schematic perspective view of a cylinder 400 having a working surface with different tribological zones 402, 404 and 406, each zone for treating in a different manner to obtain a particular embodiment of the inventive modified working surface. A first treatment may be performed by a lapping tool (such as those shown at 100 and 200 in FIGS. 9A and 9C, respectively) on zones 402 and 406, and a second treatment, such as forming one or more recessed zones, or performing a different lapping treatment, may be applied to zone 404.

It must be emphasized that the lapping technologies of the present invention may be applied to a wide variety of tribological surfaces, including, but not limited to, spherical surfaces, flat surfaces, the inside and outside of cylindrical surfaces, the outside of conical surfaces, complex surfaces, surfaces of wires, and surfaces of gears.

With regard to the composition of the contact surface of the lapping tool, the inventors have found that a mixture of epoxy cement and polyurethane in a ratio of about 25:75 to 90:10, by weight, is suitable for forming the elastic, organic, polymeric contact surface of the lapping tool. In the epoxy cement/polyurethane mixture, the epoxy provides the hardness, whereas the polyurethane provides the requisite elasticity and wear-resistance. It is believed that the polyurethane also contributes more significantly to the deposition of an organic, possibly polymeric nanolayer on at least a portion of the working surface, as will be developed in further detail hereinbelow. It will be appreciated by one skilled in the art that the production of the epoxy cement/polyurethane mixture can be achieved using known synthesis and production techniques.

More preferably, the weight ratio of epoxy cement to polyurethane ranges from about 1:2 to about 2:1, and even more preferably, from about 3:5 to about 7:5.

In terms of absolute composition, by weight, the lapping tool surface typically contains at least 10% polyurethane, preferably, between 20% and 75% polyurethane, more preferably, between 40% and 75% polyurethane, and most preferably, between 40% (inclusive) and 65% (inclusive).

The inventive contact surface of the lapping tool should preferably contain, by weight, at least 10% epoxy, more preferably, at least 35% epoxy, yet more preferably, at least 40% epoxy, and most preferably, between 40% (inclusive) and 70% (inclusive). In some applications, however, the elastic layer should preferably contain, by weight, at least 60% epoxy, and in some cases, at least 80% epoxy.

Preferably, the contact surface (lapping surface) should have the following combination of physical and mechanical properties:

- Shore D hardness within a range of 40-90, preferably 60-90, more preferably 65-82, and most preferably, 70-80;
- impact resistance (with notch) within a range of 3-20 $kJ/m^2$, preferably 3-12 $kJ/m^2$, more preferably 4-9 $kJ/m^2$, and most preferably, 5-8 $kJ/m^2$, according to ASTM STANDARD D 256-97;

It should be appreciated that a variety of materials or combinations of materials could be developed, by one skilled in the art, that would satisfy these physical and mechanical property requirements.

An exemplary lapping tool surface for use in accordance with the present invention is synthesized as follows: an epoxy resin, a polyol and a di-isocyanate are reacted at a temperature exceeding room temperature and less than about 150° C. Subsequently, a hardener is mixed in. As will be evident to one skilled in the art, the requisite curing conditions depend largely upon the particular qualities and ratios of the above-mentioned ingredients. It will be further evident to one skilled in the art that the polymer can be produced as a bulk polymer or as a molded polymer.

While advantageous ratios of the epoxy and polyurethane materials have provided hereinabove and in the claims section hereinbelow, it should be appreciated that other polymers or combinations of polymers having the requisite mechanical and physical properties for use in conjunction with the inventive device and method could be developed by one skilled in the art.

Figure 10A:
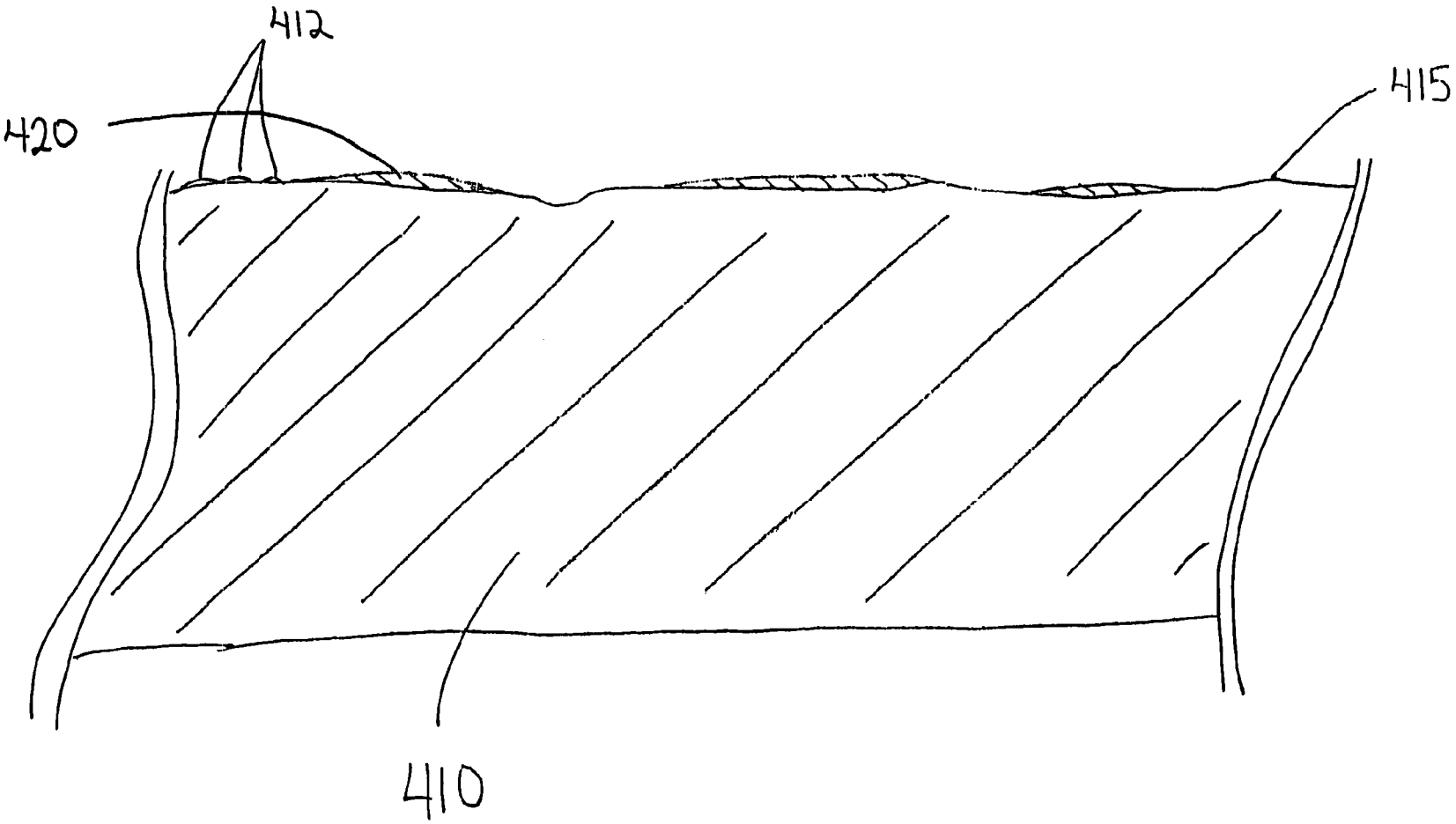
FIG. 10A is a schematic, cross-sectional diagram showing nanometric, organic particles and layers, deposited on, and intimately bonded to, the working surface, according to the present invention.

FIG. 10A is a schematic cross-section of a working surface according to one embodiment of the present invention. Using the inventive lapping technology, it has surprisingly been discovered that a nanometric organic layer 420 is disposed on a working surface 415 of workpiece 410. Typically, a substantial (though not necessarily exclusive) source of the organic material is the organic, polymeric surface of the inventive lapping tool.

Alternatively or additionally, the source of the organic material can be organic particles and materials (e.g., oligomeric or polymeric materials) added to the abrasive paste used in the lapping process.

Generally, nanometric organic layer 420 does not cover the entire area of working surface 415. There exist bare areas devoid of organic layer 420. Also, a large plurality of nanometric organic particles 412 are distributed on, and eventually become incorporated into, working surface 415. As used herein, organic particles 412 can be considered to be small patches of nanometric organic layer 420.

Without wishing to be bound by theory, the inventors believe that as the rounded abrasive particles produced by the inventive lapping process and system (see FIGS. 9B and 9C(iii) and the associated description) rotate along the working surface, a large plurality of nanometric organic particles disposed on working surface 415 are flattened against the contour of surface 415 by this rotating action under the load of the lapping system.

In areas of working surface 415 in which the population density of the nanometric organic particles is high, the lapping process forms a relatively large nanometric organic layer, such as nanometric organic layer 420. In areas of working surface 415 in which the population density of the nanometric organic particles is lower, the lapping process flattens the particles against the contour of surface 415 to form flattened nanometric particles such as organic particles 412.

The intimate bonding of the solid nanometric organic layer 420 (including nanometric organic particles 412) to working surface 415 is greatly enhanced by aging of workpiece 410, as will be described in further detail hereinbelow.

After the aging of workpiece 410, organic layer 420 is more strongly bonded to working surface 415. Organic layer 420 is nanometric, typically having an average thickness of up to 30 nm, and more typically, 1-20 nm. Excellent experimental results have been obtained for working surfaces having nanometric layers within this range of thickness.

It must be emphasized that the inventive working surface of FIG. 10A, and the inventive method for producing the surface, differ from known coated working surfaces and methods in various fundamental ways. These include:

- the inventive layer has a thickness of up to 30 nm. By sharp contrast, known coatings have a thickness exceeding several microns.
- the deposition of the nanometric layer is advantageously performed by the inventive lapping method itself;
- the material source of the organic material in the nanometric layer is the inventive contact surface of the lapping tool, or materials disposed in the paste;
- the material source of the inorganic material in the nanometric inorganic layer (or disposed in the organic nanometric layer) is materials disposed in the paste;
- the nanometric organic and inorganic layers are intimately bonded to the working surface and follow the nanometric contours of the working surface;
- the nanometric organic and inorganic layers strongly adhere to the working surface. Consequently, these layers are not subject to the phenomena of peeling, flaking, crumbling, etc., characteristic of various coatings of the prior art;
- the microstructuring is performed prior to deposition of the organic layer.

Figure 10B:
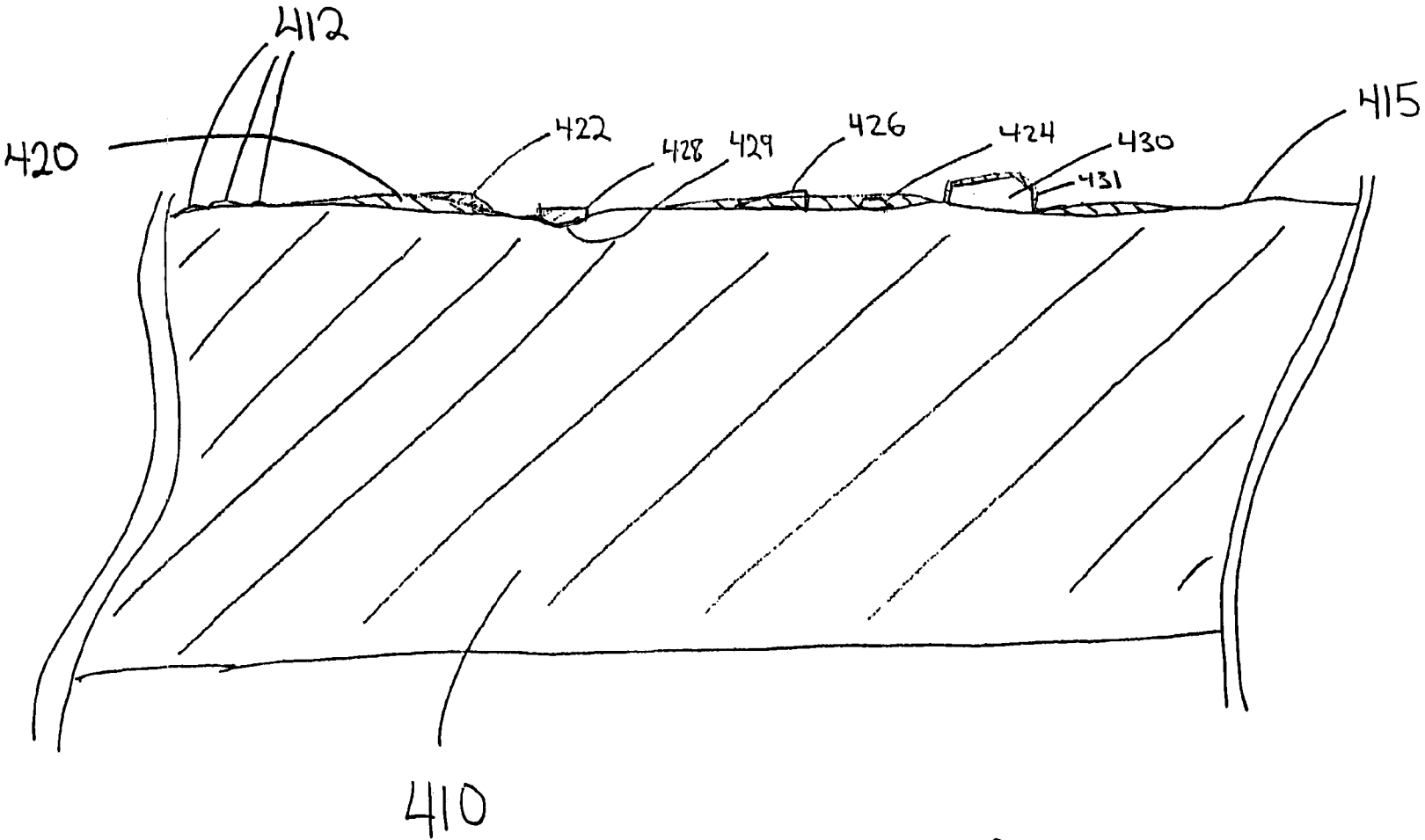
FIG. 10B is the schematic, cross-sectional diagram of FIG. 10A, in which are shown inorganic nanoparticles incorporated in the working surface, according to another aspect of the present invention.

FIG. 10B is the schematic, cross-sectional diagram of FIG. 10A, in which are shown inorganic abrasive particles 422, 424, 426, 428, 430 incorporated in working surface 415 of workpiece 410, according to another aspect of the present invention. Particle 422 is disposed on, and attached to, organic nanolayer 420. Particle 424 is disposed completely within organic nanolayer 420. Particle 426 is disposed within organic nanolayer 420, but has an exposed face protruding out of organic layer 420. Particle 428 is disposed on, and attached directly to, working surface 415. In this particular example, particle 428 is mechanically wedged in to a recess 429 of working surface 415. Without wishing to be limited by theory, it is believed that as the rounded abrasive particles produced by the inventive lapping process and system (see FIGS. 9B and 9C(iii) and the associated description) roll along the working surface under the load of the lapping system, solid particles such as solid particle 428 are embedded and subsequently packed into the working surface. Similarly, it appears that particles 422 and 426 are similarly embedded in organic nanolayer 420, where the softness relative to the rest of working surface 415, along with the adhesive properties of nanolayer 420, result in the particles being firmly attached to nanolayer 420, and consequently, become an integral part of working surface 415.

Although not drawn to scale, abrasive particle 430 schematically represents a large particle (e.g., having a diameter of several microns) covered by a thin organic nanolayer 431.

The inventors have further discovered that the properties of the working surface are modified by the inventive incorporation of hard solid particles therein.

Figure 11A:
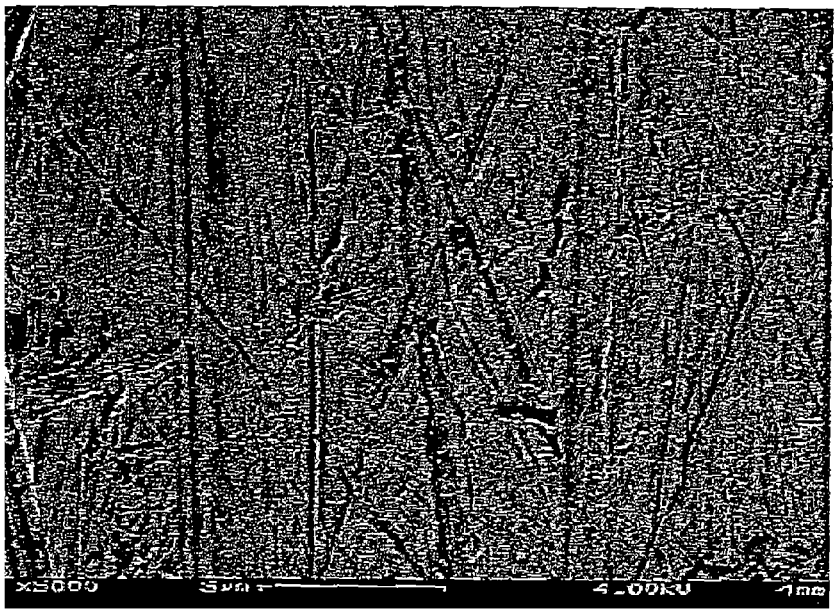
FIGS. 11A and 11B are scanning electron microscope (SEM) images of cleaned working surfaces produced using conventional (cast iron and aluminum, respectively) lapping tool surfaces.
Figure 11B:
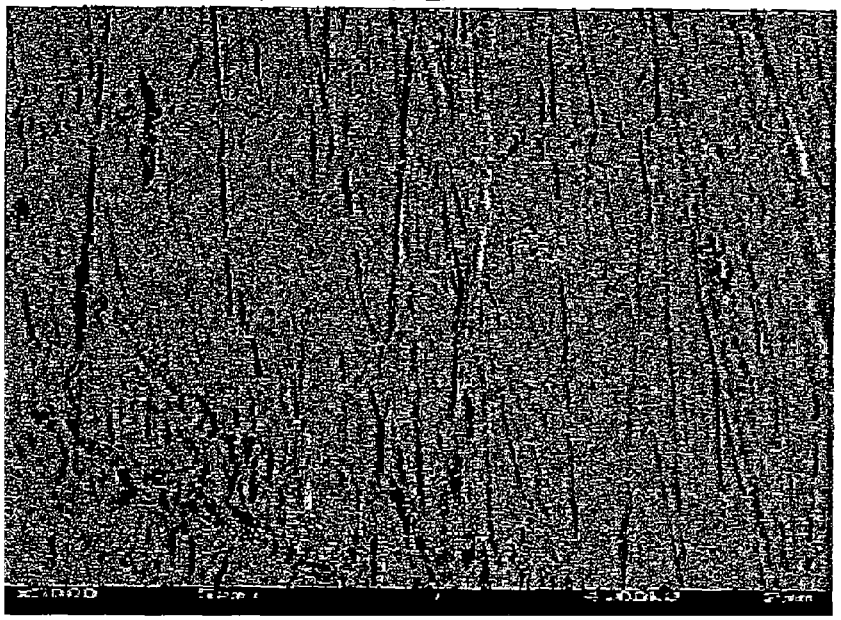
PRIOR ART FIGURE 11 B

FIGS. 11A and 11B are scanning electron microscope (SEM) images of cleaned working surfaces produced using conventional lapping tool surfaces. FIG. 11A is a SEM image of a steel working surface lapped with a cast iron lapping tool surface; FIG. 11B is a SEM image of a substantially identical steel surface lapped with an aluminum lapping tool surface. Each image represents, approximately, a 22 micron by 17 micron portion of the respective steel working surface.

Figure 12B:
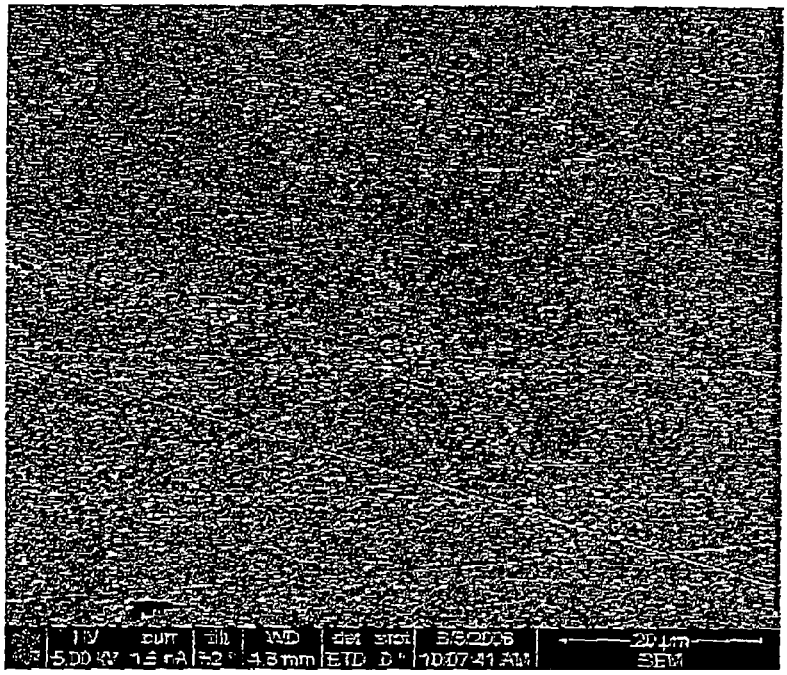
FIG. 12B is the SEM image of FIG. 12A, shown at a lower magnification.
Figure 12A:
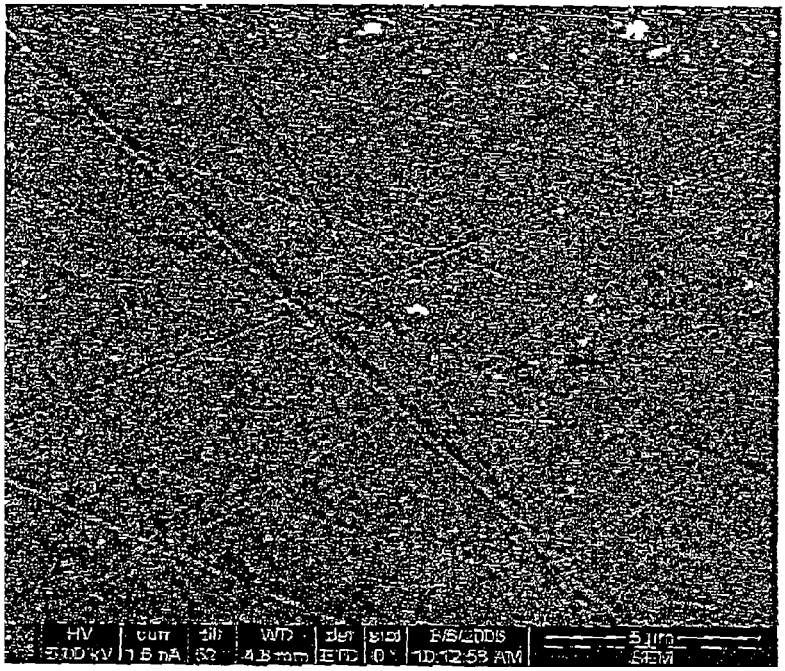
FIG. 12A is a SEM image of a cleaned steel working surface lapped with a polymeric lapping tool surface and subjected to an aging process in an ambient environment, according to the present invention.

FIG. 12A is a SEM image of a cleaned steel working surface lapped with a polymeric lapping tool surface of the present invention, and aged in an ambient environment for over 1 week. The steel sample used is substantially identical to the steel samples used with the conventional lapping tool surfaces described above. The magnification is also substantially identical to the magnification of FIGS. 11A and 11B.

It is manifestly evident that the steel working surface lapped with the inventive polymeric lapping tool surface is characterized by a much lower average surface roughness. In addition, the characteristic amplitude of the surface topography ($R_Z$) is much lower, and the characteristic slope ($R_{\Delta Q}$) is much more gradual.

More surprisingly, a large plurality of light-colored spots is disposed on the inventive working surface shown in FIG. 12A. This large plurality of spots is even more pronounced in the same inventive working surface, shown at lower magnification in FIG. 12B. No such spots are observed on the working surfaces of the prior art (FIGS. 11A and 11B).

Figure 11C:
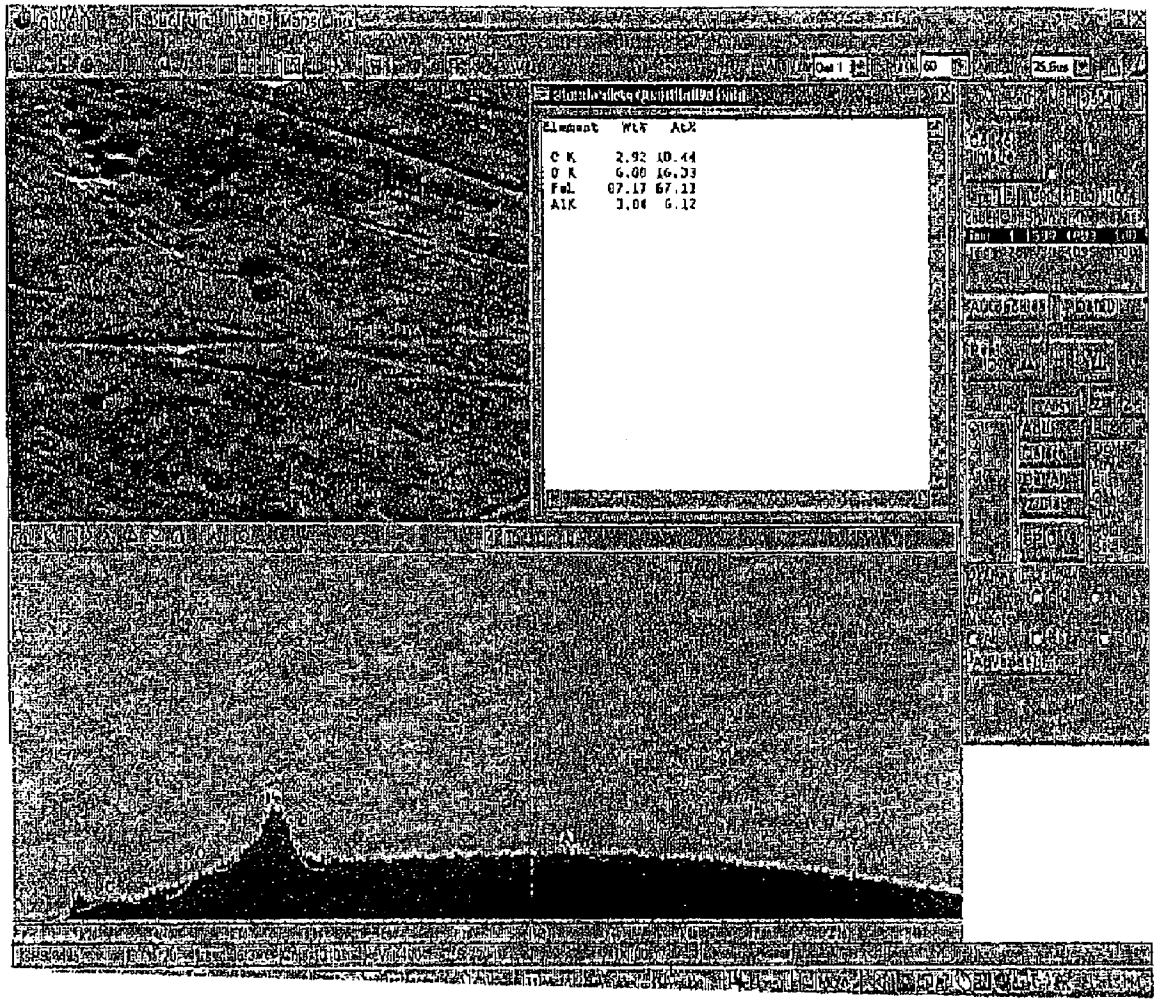
FIG. 11C PRIOR ART
FIG. 11C is a SEM image and an energy dispersion spectrography (EDS) spectrograph of the a cleaned working surface produced using a conventional aluminum lapping tool surface.
Figure 12C:
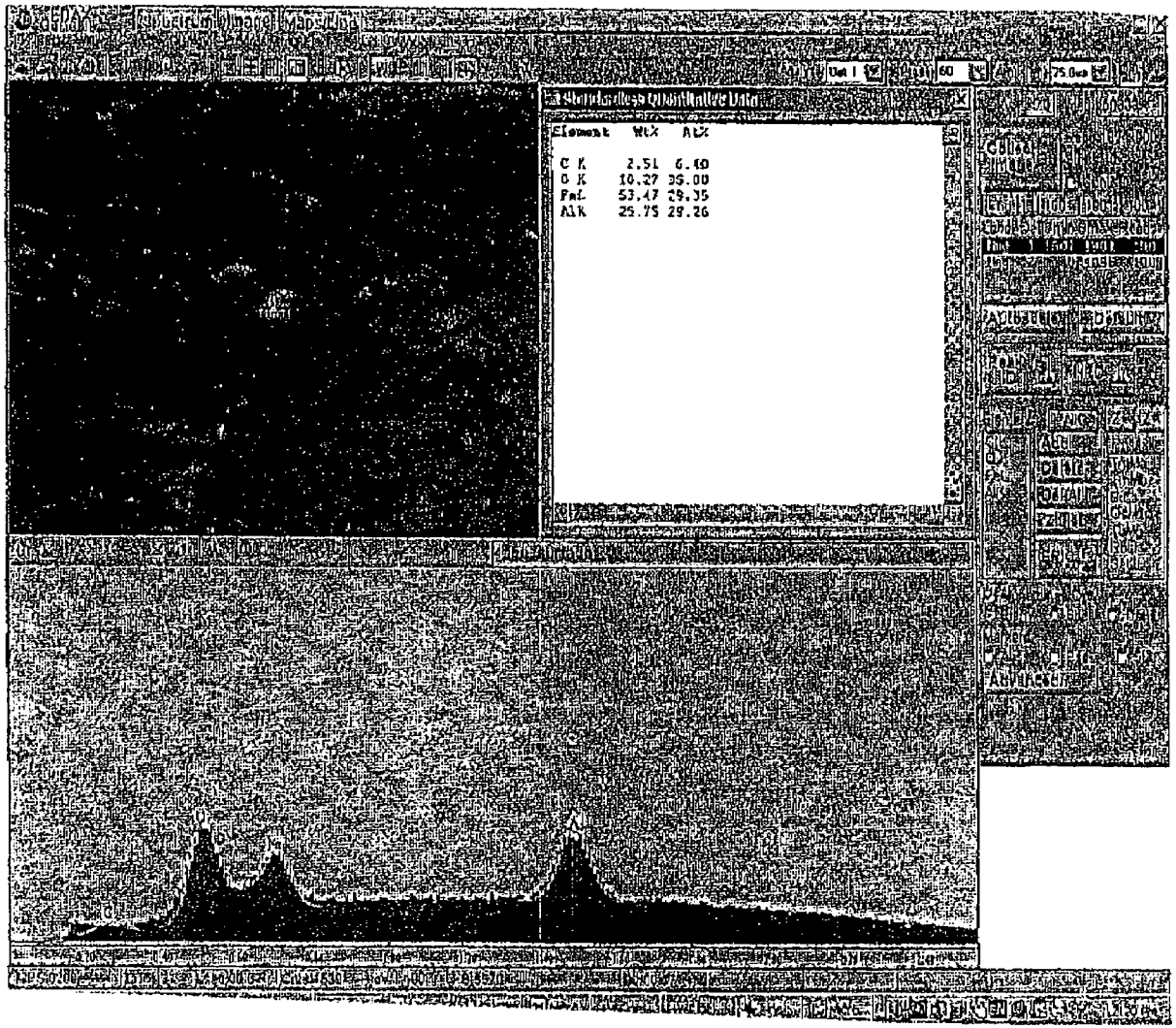
FIG. 12C is a SEM image and an energy dispersion spectrography (EDS) spectrograph of the inventive working surface.

The light-colored spots on the working surface contain a high concentration of alumina, as is evident from the energy dispersion spectrography (EDS) spectrograph provided in FIG. 12C. Upon focusing on such a light-colored spot, the EDS spectrograph shows both a distinct aluminum peak and a distinct oxygen peak. By sharp contrast, no such peaks were observed anywhere on the working surfaces produced using conventional lapping tool surfaces and a conventional abrasive paste containing alumina particles. An exemplary EDS spectrograph of such a conventional working surface (produced using an aluminum lapping tool surface) is provided in FIG. 11C. No aluminum peak was detected.

It must be emphasized that the alumina particles of the inventive working surface are incorporated and firmly embedded in the surface. After lapping, the working surfaces are subjected to a rigorous cleaning process to remove loose particulate matter and organic debris.

As used herein in the specification and in the claims section that follows, the term "cleaning", "cleaned", or "cleaning process", with respect to a working surface, refers to the following procedure:

(step 1) immersion of the working surface in a bath filled with isopropanol or ethanol, and subjecting the immersed working surface to ultrasonic treatment for at least one minute;

(step 2) washing in ethanol followed by wiping the surface with a cloth soaked in ethanol, and (step 3) subjection to a vacuum of 10−7 torr (preferably up to 10−10 torr) for at least 5 minutes, wherein the specific parameters of the ultrasonic treatment, the washing in ethanol, and the wiping are performed so as to remove loose particulate matter and organic debris, according to techniques that are known to one skilled in the art.

It must be emphasized that over the course of extensive testing of lapped and cleaned working surfaces using conventional lapping tool surfaces (cast iron, aluminum), no alumina particles were detected in any of the working surfaces.

By sharp contrast, lapped and cleaned working surfaces produced using the inventive polymeric lapping tool surface and a conventional abrasive paste containing alumina particles have a population density of at least 2,000 alumina particles per square millimeter, typically, at least 10,000 alumina particles per square millimeter, more typically, at least 50,000 alumina particles per square millimeter, yet more typically, at least 100,000 alumina particles per square millimeter, and most typically, 300,000-600,000 particles per square millimeter.

In terms of coverage area, the coverage area of the incorporated alumina particles is at least 0.1% of the nominal surface area of the working surface, typically, at least 0.5%, and more typically, at least 2%. Various working surfaces of the present invention were found to have coverage areas in the range of 3% to 6%.

As is evident from the SEM image provided in FIG. 12A, the alumina particles (i.e., the spots identified as alumina by EDS) are extremely small. In SEM images of higher magnification, the size of each alumina particle is more easily quantifiable. In any event, extensive testing shows that at least 90% of the particles have a diameter of less than 1 micron (1000 nanometers). In many cases, at least 90% of the abrasive particles have a diameter of less than 300 nanometers. In some cases, at least 50% of the abrasive particles have a diameter of less than 100 nanometers. The smallest particles measured to date have a diameter of no more than 10 nanometers.

Typically, the alumina used in the abrasive pastes used in the inventive lapping process is fused alumina. However, as used herein in the specification and in the claims section that follows, the term "alumina" refers to all forms of alumina, including fused alumina, unfused alumina, alpha alumina, gamma alumina, and natural alumina or alumina-containing materials such as corundum and emery.

More generally, other pastes containing inorganic abrasives can be used in conjunction with the inventive lapping process and inventive contact surface to produce the inventive working surface. Although experimentation is ongoing, one common denominator of the incorporated inorganic abrasive particles is hardness: the hardness should be at least 8 on the Mohs scale. The presently preferred hardness is 8 to 9.5, inclusive. Thus, in addition to different forms of alumina, garnet, corundum, silicon carbide, and boron carbide are suitable, or appear to be suitable for incorporation into working surfaces, to produce the working surface of the present invention. Also, the above-delineated characterizations of population density, coverage area, and particle size with respect to alumina incorporated on the working surface, may be broadly applicable to other such inorganic abrasives.

Figure 13:
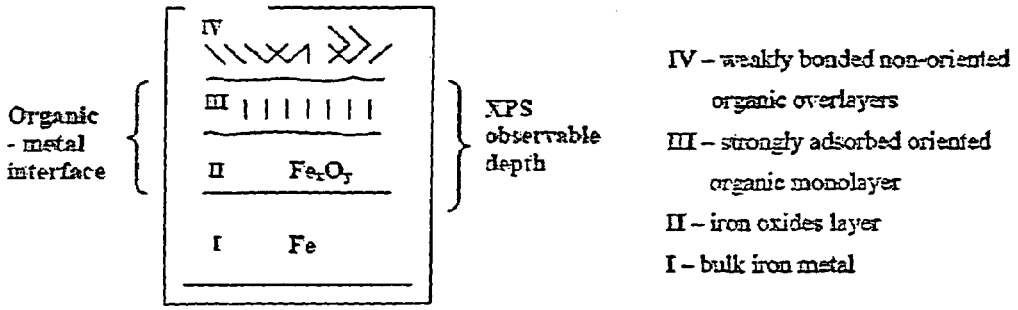
PRIOR ART FIGURE 13
FIG. 13 is a schematic representation of a typical metal surface.

Referring back to FIG. 10A, and without wishing to be limited by theory, some of the characteristics of the inventive tribological surface can be understood in relation to conventional metal surface structures. A typical metal surface is a multi-layer "sandwich" composed of 4 basic layers, as illustrated in FIG. 13. An oxide layer II, which covers the bulk metal I, is about 2-5 nm deep. An oxide layer formed within seconds after exposure of the metal to air, as well as during machining operations such as grinding or lapping. The oxide layer is tightly bonded to the base metal by strong ionic forces, as explained in Table 2 below, and in fact becomes an integral part of the metal surface.

The surface of the oxide layer is covered by polar hydroxyl OH groups that are responsible for the adsorption of organic compounds, polar and non-polar, on the metal surfaces. In the case of polar organic molecules with carbon-oxygen polar groups such as COOH, strong polar-covalent bonds (see Table 2 below) are formed between the polar groups in the organic molecules and the surface of the oxide. This strong chemical bond forms an organic monolayer (designated III in FIG. 13) approximately 2-3 nm deep, with its polar groups facing towards the metal surface ("chemical adsorption").

The oriented organic monolayer (III) can, in turn, assemble several loosely formed layers of non-polar organic compounds such as fingerprint oil and dust, as well as other carbon-based debris. This organic, non-oriented overlayer (IV) is bonded to the surface by weak dispersive electrostatic forces (Van der Waals forces) that are easily cleansed by solvents and/or are readily removed in vacuum ("physical adsorption").

TABLE 2

Bonding Strength Between Layers on the Working Surface

Figure 1B:
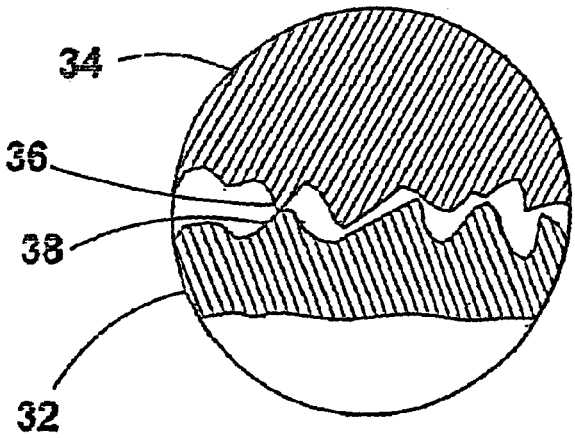
Fig. 1B PRIOR ART
FIG. 1B is a schematic description of mechanically interacting surfaces having interacting asperities.

| Interface between layers | FIG. 1 designation | Type of bond | Bonding strength (KJ/mol) | Comments |
|---|---|---|---|---|
| Metal - oxide | I-II | Ionic bonds | ~1,000 - Very strong | |
| Oxide - oriented organic layer | II-III | (Polar) Covalent bonds | ~700 - Strong | Polar - in the case of polar organic groups |
| oriented organic layer - non-oriented organic layer | III-IV | Van der Waals | ~10 - Weak | |

Several steel samples were lapped either by using standard a lapping method with a cast iron lapping tool, or by using the polymer-surfaced lapping tool of the present invention. All samples were machined with the same, commercially-available aluminum oxide abrasive paste. After lapping, the samples were carefully cleaned (to remove overlayer IV) and were analyzed by X-ray Photoelectron Spectroscopy (XPS), which is used to evaluate atomic and chemical composition of the near-surface layers.

One goal of the XPS study was to analyze the organic-metal interface, i.e., layers II and III. The main information about the organic monolayer (III) was obtained from carbon C1s spectra as shown in FIGS. 14A and 14B. The C1s signal of the polymer-lapped sample (FIG. 14A) reveals a significant increase of polar C═O/COOH groups content in the near-surface layers when compared with C1s signal of the conventionally lapped steel sample (FIG. 14B). It is well known that such C═O or COO—/COOH polar groups in organic molecules interact with Fe/FeO/FeOH reactive sites in the metal surface by forming strong polar-covalent or even ionic chemical bonds (like in metal salts RCOOFe); thus leading to the strong interaction between the organic monolayer and the oxide surface.

The inventive polymer lapping surface is, by its chemical nature, very rich in various polar organic groups. During the lapping process, the abrasive particles scratch/tear out small fragments from the polymeric lapping tool. These organic or polymeric fragments, which appear to have substantially the same composition as the polymer-surfaced lapping tool, contain reactive polar groups. As a result of the lapping process, these reactive fragments reach the metal surface. Simultaneously, the abrasive particles (e.g., alumina) also abrade the oxide layer and the base metal, thus activating the metal surface and stimulating the chemical interaction with the reactive fragments.

As a result of this mechano-chemical process, strongly bonded organic fragments cover at least a portion of the metal surface and form a unique organic/metal interface.

Commercial engine oils contain organic acid additives, which are surface-active compounds having polar groups that improve the oil adhesion to the metal surface. These organic acid additives are bonded to the polar metal surface by covalent bonds, which form a boundary monolayer (similar to layer III) with polar groups oriented towards the metal surface and the non-polar groups oriented away from the surface.

The non-polar "upper" side of the monolayer orients non-polar oil molecules thereby forming a structured multi-layered lubricating film that is required for good lubrication (similar to layer IV).

Figure 15:
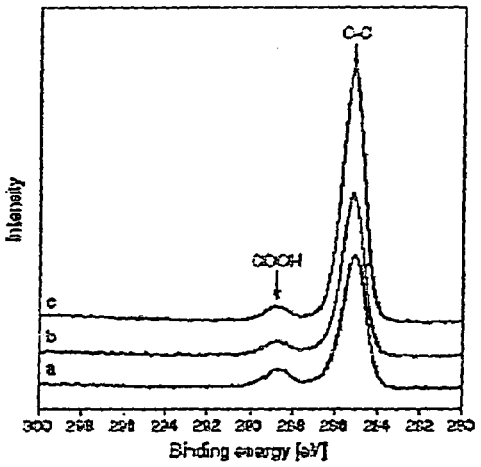
PRIOR ART FIGURE 15
FIG. 15 shows XPS spectra of several motor oil additives.

During lapping using the inventive lapping tool, the organic monolayer (III) is bonded much more strongly to the metal surface than any boundary layer created with organic acid additives in oil because, inter alia, a much larger concentration of active polar groups becomes bonded to the surface. XPS spectral data (C1s) of such organic acid additives are provided in FIG. 15. It can be observed that the surface, following treatment using the inventive polymer-surfaced lapping tool, contains a much higher ratio of polar to non-polar groups (FIG. 14A) than those found with acid additives (FIG. 15).

Figure 16:
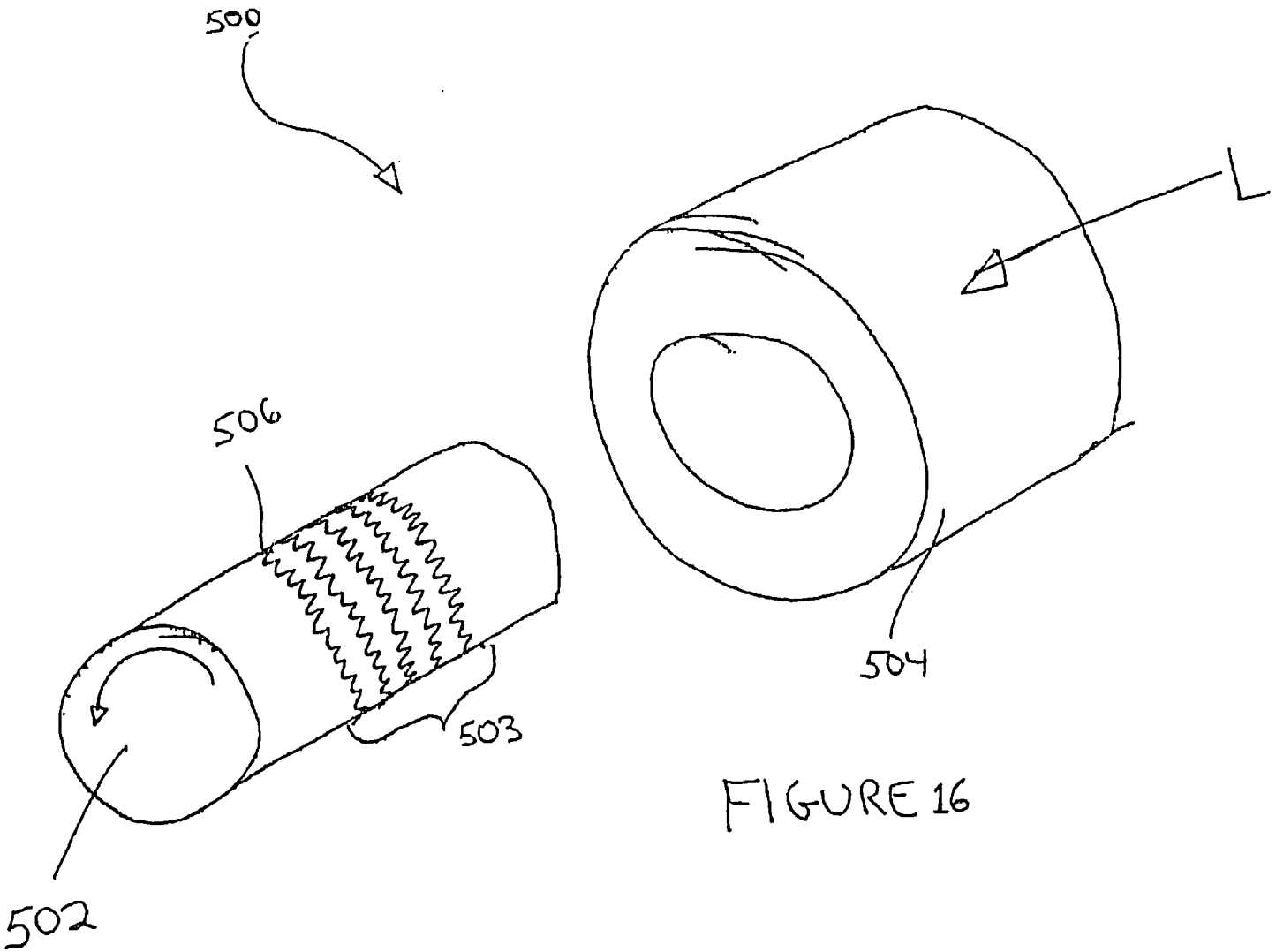
FIG. 16 is a schematic drawing of an exemplary tribological system according to one aspect of the present invention.

FIG. 16 is a schematic drawing of an exemplary tribological system 500 according to one aspect of the present invention. Tribological system 500 includes a rotating working piece 502 (mechanism of rotation, not shown, is standard), having a working surface (contact area) 503 bearing a load L, a counter surface disposed within stationary element (bushing) 504, and a lubricant (not shown) disposed between working surface 502 and counter surface 504. Working surface 503 is an inventive working surface of the present invention, as described hereinabove. Optional recessed zones (grooves 506) serve as a reservoir for the lubricant and as a trap for debris.

It must be emphasized that, as demonstrated experimentally, the inventive working surface achieves a surprisingly-high performance with respect to working surfaces produced by various conventional lapping technologies.

Moreover, the presence of abrasive particles in a tribological system such as a bearing or seal is known to seriously compromise the tribological performance. Thus, the discovery of the inventors that the incorporation of abrasive particles into a working surface can actually improve the tribological performance of the surface is indeed surprising.

In another embodiment of the present invention, the inventive work surface and inventive lapping method and device are utilized in the production of artificial joints, e.g., hip joints. Conventional hip joints suffer from a number of disadvantages, which tend to reduce their effectiveness during use, and also shorten their life span. First, since the synovial fluid produced by the body after a joint replacement operation is considerably more diluted and thus 80% less viscous than the synovial fluid originally present, the artificial joint components are never completely separated from each other by a fluid film. The materials used for artificial joints, as well as the sliding-regime parameters, allow only two types of lubrication: (i) mixed lubrication, and (ii) boundary lubrication, such that the load is carried by the metal femoral head surface sliding on the plastic or metal acetabular socket surface. This results in accelerated wear of the components, increasing the frictional forces, and contributes to the loosening of the joint components and, ultimately, to the malfunction of the joint.

The high wear rate of the ultra-high-weight polyethylene (UHWPE) cup results in increased penetration of the metal head into the cup, leading to abnormal biomechanics, which can cause loosening of the cup. Furthermore, polyethylene debris, which is generated during the wearing of the cup, produces adverse tissue reaction, which can induce the loosening of both prosthetic components, as well as cause other complications. Increased wear also produces metal wear particles, which penetrate tissues in the vicinity of the prosthesis. In addition, fibrous capsules, formed mainly of collagen, frequently surround the metallic and plastic wear particles. Wear of the metal components also produces metal ions, which are transported, with other particles, from the implanted prosthesis to various internal organs of the patient. These phenomena adversely affect the use of the prosthesis.

In addition, bone and bone cement particles, which remain in the cup during surgery, or which enter the contact zone between the hip and the cup during articulation, tend to become embedded in the cup surface. These embedded bone particles can cause damage to the head, which can, in turn, bring about greatly increased wear of the cup.

The treatment of the head friction surface using microstructuring technology, so as to reduce the wear of the friction surfaces, has been suggested in the literature (see Levitin, M., and Shamshidov, B., "A Laboratory Study of Friction in Hip Implants", Tribotest Journal 5-4, June 1999, the contents of which are incorporated by reference for all purposes as if fully set forth herein). The microstructuring technology improves lubrication and friction characteristics, and facilitates the removal of wear debris, bone fractions, and bone cement particles from the friction zone between the male and female components of the joint.

Figure 17:
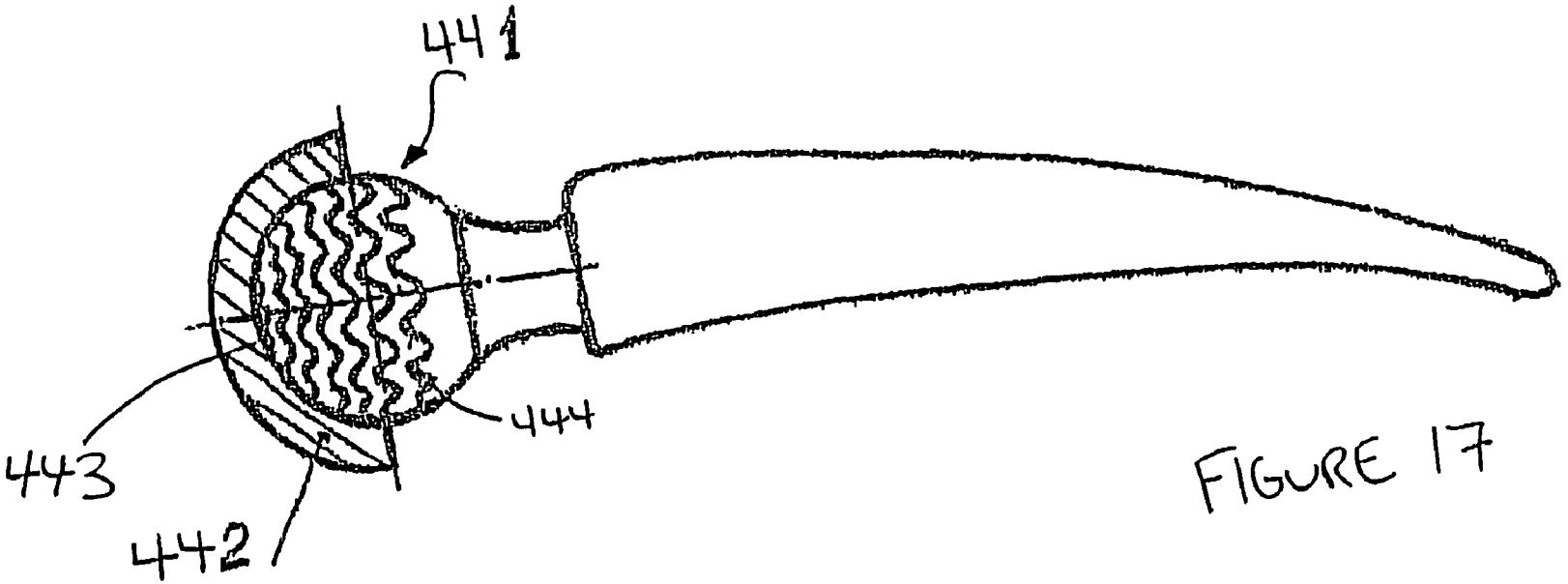
FIG. 17 is a cross-sectional schematic illustration of an artificial joint for implanting in a living body.

There is, however, a well recognized need for further improvement in reducing friction and wear in artificial joints. In another embodiment of the present invention, shown in FIG. 17, a metal joint head 441 is engaged within a metal cup 442. Optionally, metal joint head 441 has grooves 444 (recesses, pores, etc.) according to microstructuring technologies known in the art. Metal joint head 441 has been subjected to the lapping methods of the present invention, so as to produce the inventive working surface. Preferably, a working surface 443 of metal joint head 441 is at least partially covered with a nanometric organic layer, as described hereinabove with reference to FIG. 10A. It is also preferable to have hard, inorganic nanometric particles incorporated into working surface 443, as described hereinabove with reference to FIG. 10B.

As used herein in the specification and in the claims section that follows, the term "impact resistance" refers to the impact resistance, with notch, in units of $kJ/m^2$, as determined by ASTM STANDARD D 256-97.

As used herein in the specification and in the claims section that follows, the term "Shore D hardness", and the like, refers to a measure of the resistance of material to indentation, according to the standard ASTM test (D 2240-97).

The hardness testing of plastics and hard rubbers is most commonly measured by the Shore D test, with higher numbers signifying greater hardness.

As used herein in the specification and in the claims section that follows, the term "freely disposed", regarding abrasive particles, relates to the free-flowing state of abrasive particles as in typical lapping methods of the prior art.

As used herein in the specification and in the claims section that follows, the term "intimately bonded", with respect to a layer and a working surface, refers to a nanometric layer having a contour that substantially complements the microcontour of the working surface, such that the layer is firmly attached to the working surface along the entire contour thereof.

As used herein in the specification and in the claims section that follows, the term "metal surface layer" is meant to include a metal oxide layer bonded to the base metal layer, as described with respect to FIG. 13.

As used herein in the specification and in the claims section that follows, the term "aging" and the like refers to a process of at least 24 hours in which the working surface is allowed to mature, and in which various chemical interactions transpire.

As used herein in the specification and in the claims section that follows, the term "oxygen-rich environment" and the like refers to an environment containing at least 2% oxygen gas, by volume.

As used herein in the specification and in the claims section that follows, the term "incorporated", "incorporation", and the like, with respect to a particle or nanolayer and with respect to a working surface, refers to a particle or nanolayer that is so strongly attached to the working surface, that the particle or nanolayer remain attached thereto even after the working surface has been subjected to a cleaning process, as defined hereinabove.

As used herein in the specification and in the claims section that follows, the term "coverage area", with respect to particles or at least one nanolayer disposed on a working surface, refers to the relative area, expressed as a percentage, of the area of the working surface on which these particles or one or more nanolayers are disposed, and the nominal surface area of the working surface.

As used herein in the specification and in the claims section that follows, the term "nanometric", with respect to an abrasive particle, refers to a particle having a diameter of up to 5,000 nanometers, typically 10-5,000 nanometers, more typically, 50-2,000 nanometers, and in some cases, up to 1,000 nanometers.

As used herein in the specification and in the claims section that follows, the term "nanometric", with respect to an organic particle, refers to a particle having a diameter of up to 5,000 nanometers, typically 1-5,000 nanometers, more typically, 50-2,000 nanometers, and in some cases, up to 1,000 nanometers. The term "organic particle" is also meant to include an abrasive particle that is covered by an organic layer (e.g., abrasive particle 430 covered by thin organic nanolayer 431 as shown schematically in FIG. 10B).

As used herein in the specification and in the claims section that follows, the term "nanometric", with respect to a layer, refers to a layer having a thickness of 1-30 nanometers, more typically, 1-20 nanometers, and most typically, 2-10 nanometers.

EXAMPLES

Reference is now made to the following examples, which together with the above description, illustrate the invention in a non-limiting fashion.

Example 1

Comparative Surface Analysis Using X-Ray Photoelectron Spectroscopy (XPS)

Surface Analyses of lapped samples were performed using XPS. The apparatus and analysis conditions were as follows:

| | |
|---|---|
| Instrument: | VG Scientific Sigma Probe |
| X-ray source: | Monochromatic Al Kα, 1486.6eV |
| X-ray beam size: | 400 μm |
| Charge neutralization: | 6eV electrons (used for the polymer sample) |
| Argon Ion Beam: | 4.0 keV |
| Sputtering Rate: | calibrated with a 20 nm thick $SiO_2$ standard |
| Software Analysis: | Sigma Probe Avantage |

For surface analysis, the samples were irradiated with monochromatic X-rays. Survey spectra were recorded with a pass energy of 100 eV, from which the surface chemical composition was determined. Depending on the element, the depth of analysis is up to ~10 nm, with ~63% of the information originating from the top layer having a thickness of 3 nm. The survey scans are presented as plots of the number of electrons measured as a function of the binding energy.

For identification of the chemical state, high-energy resolution measurements were performed with a pass energy of 20 eV. The core level binding energies of the different peaks were normalized by setting the binding energy for the C1s at 285.0 eV.

For lapped steel samples, a depth profile of relevant elements was acquired in the alternate sputtering mode using a beam of argon ions. Sputtering depths are reported as the silicon oxide equivalent.

Steel Samples Lapped by Cast Iron (Prior Art)

A first sample, lapped by cast iron according to conventional methodology, was evaluated on the day of preparation (after lapping with cast iron, according to conventional lapping methodology). A second sample was evaluated after 3 weeks of storage (after lapping) in a clean closed box.

Figure 18:
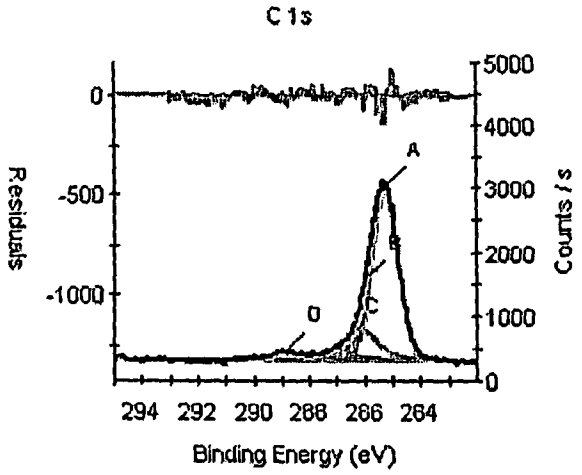
FIGS. 18 and 19 show typical high resolution spectra of C1s measured from the conventionally-lapped steel sample on the day of preparation and 3 weeks after preparation, respectively.
Figure 19:
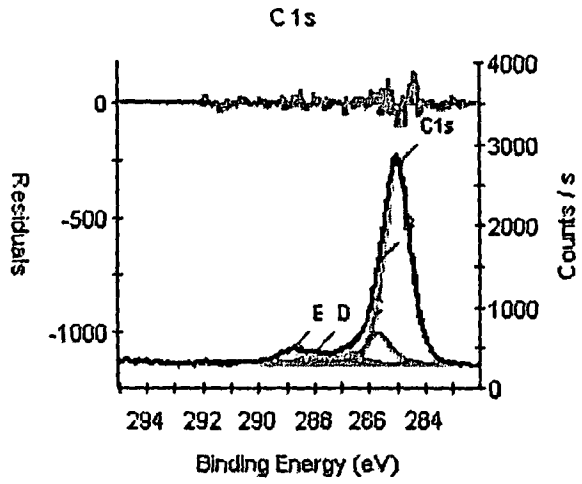

FIGS. 18 and 19 show typical high-resolution spectra of C1s measured from the conventionally-lapped steel sample on the day of preparation and 3 weeks after preparation, respectively.

For the sample measured on the day of preparation, a carbon concentration of 70% was found at the surface. Most of the carbon bonds were identified as C—H. After storage of the sample, no significant change in the concentration of carbon and in the distribution of carbon-oxygen bonds was observed.

Also, no significant reduction in the amount of oxidized Fe was observed between the stored sample and the initial sample. This indicates that no chemical reaction occurred between the steel substrate and the carbon-based material.

Sample of the Polymeric Contact Surface

Figure 20A:
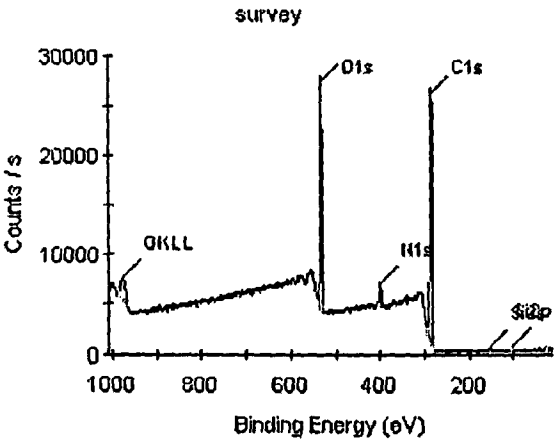
FIG. 20*a* presents a typical XPS survey spectrum measured from the fractured polymer surface.

A clean polymer sample surface was prepared by fracturing the polymer in air and immediately transferring the material into the UHV chamber of the XPS instrument. FIG. 20*a* presents a typical XPS survey spectrum measured from the fractured polymer surface. The spectrum demonstrates the presence of C, O, N and small amounts of Si.

Figure 20B:
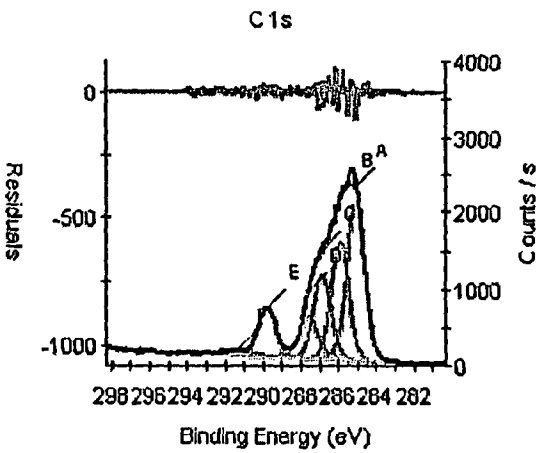
FIGS. 20*b*-20*d* show high-resolution spectra of C1s, O1s and N1s, respectively, measured from the fractured polymer surface of FIG. 20*a;*
Figure 20C:
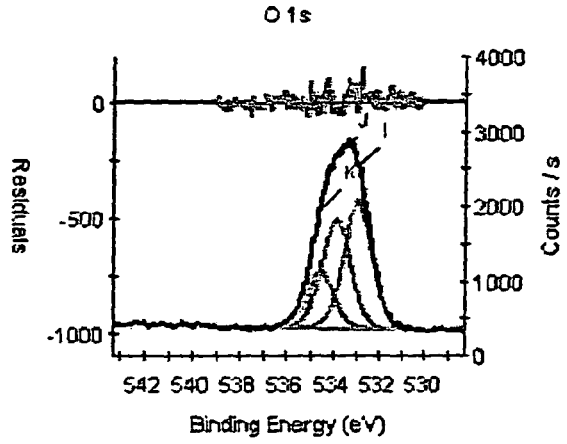
Figure 20D:
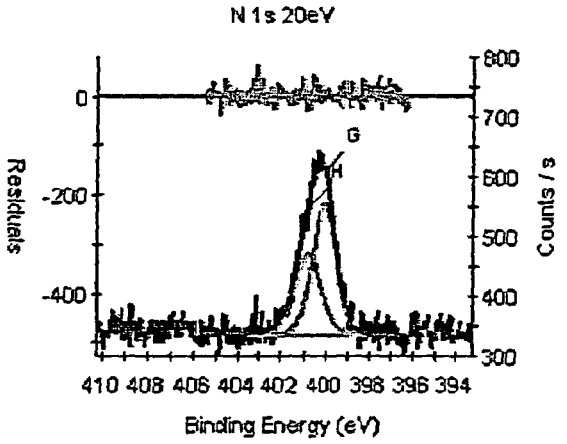

FIGS. 20*b*-20*d* show high-resolution spectra of C1s, O1s and N1s, respectively, measured from the same fractured polymer surface.

The C1s spectrum was curve-fitted with 6 components as summarized in Table 3.

TABLE 3

Binding energies (BE) and atomic concentrations (AC) of different C species measured for the polymer sample

| Functional groups | AC (%) | BE (eV) | C1s components |
|---|---|---|---|
| C—H | 25.7 | 284.99 | A |
| O—C═O | 20.3 | 285.66 | B |
| C, C—OH—O—C | 14.1 | 286.85 | C |
| C—O—C═O | 5.4 | 287.54 | D |
| O═C—O—C═O | 9.1 | 289.70 | E |
| aromatic | — | 291.86 | F |

While binding energy line or peak A (284.99 eV) can be related to carbon bounded to hydrogen (irrespective of hybridization), the higher binding energy lines B, C, D and E can be assigned to different types of carbon-oxygen bonds. The F component is a characteristic shake-up line for carbon in aromatic compounds. The O1s and N1s spectra were curve fitted with three and two components, respectively.

The XPS analysis of the bulk polymer sample identified the presence of ~3% of nitrogen and a number of different carbon-oxygen chemical bonds characteristic to the inventive polymeric lapping surface.

Steel Sample Lapped by a Lapping Tool Having the Polymer Surface

Samples 1-3 were measured on the day of preparation, after 1 day of aging, and after 2 weeks of aging. The aging process was performed in a clean, closed box.

Figure 21:
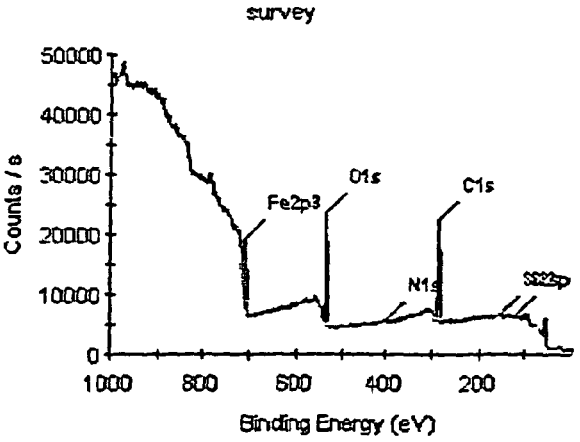
FIG. 21 presents a typical XPS survey spectrum measured from the (polymer) lapped steel sample on the day of preparation (Sample 1)

FIG. 21 presents a typical XPS survey spectrum measured from the (polymer) lapped steel sample on the day of preparation. The spectrum demonstrates the presence of C, O, Fe, Si and small amounts of Ni.

Figure 22A:
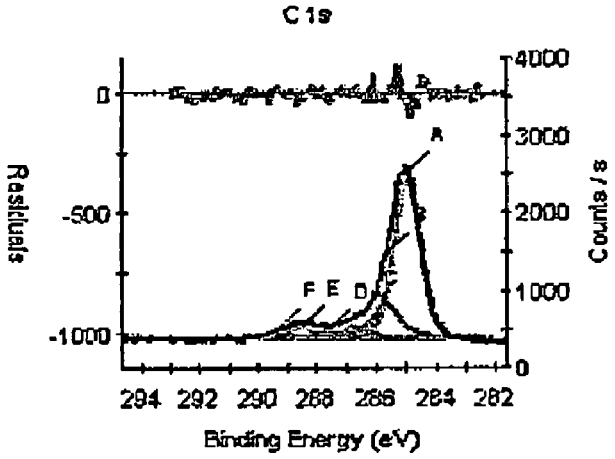
FIGS. 22*a*-22*c* show typical high-resolution spectra of C1s measured from samples measured on the day of preparation (Sample 1); after 1 day of aging (Sample 2); and after 2 weeks of aging (Sample 3), respectively.
Figure 22B:
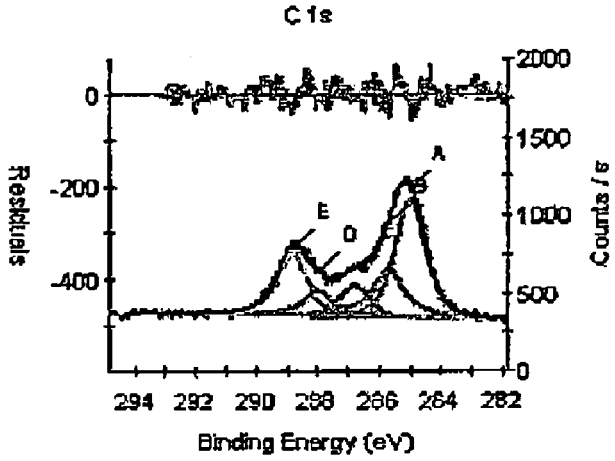
Figure 22C:
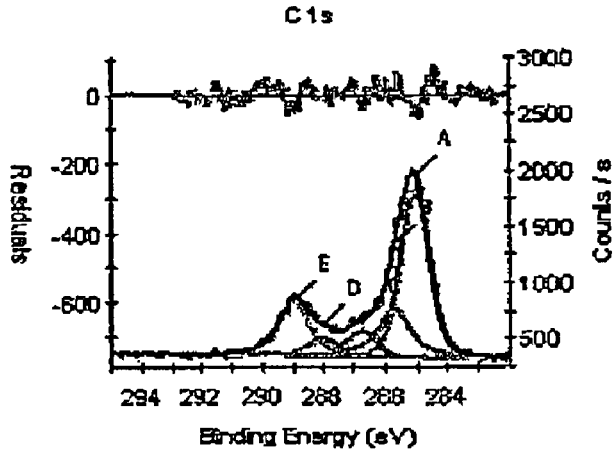

FIGS. 22*a*-22*c* show typical high-resolution spectra of C1s measured from Samples 1-3, respectively.

Figure 23A:
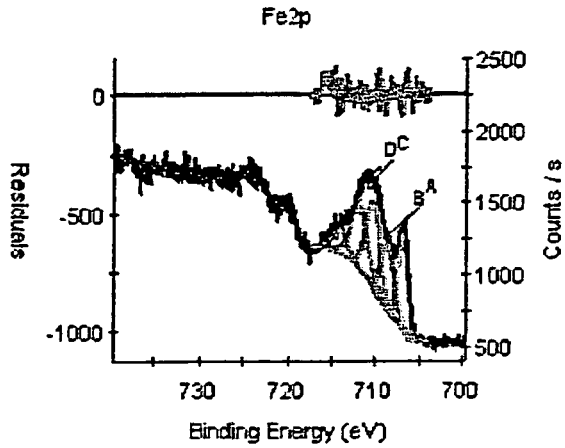
FIGS. 23*a*-23*c* show typical high-resolution spectra of Fe2p measured from Samples 1-3, respectively.
Figure 23B:
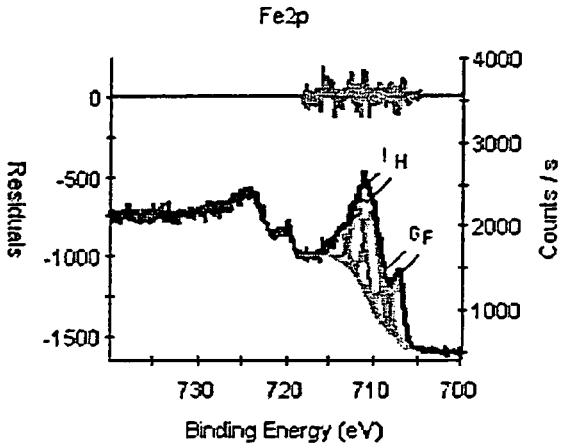
Figure 23C:
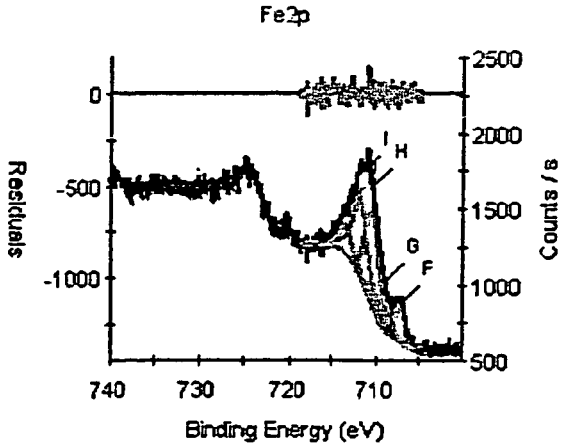

Similarly, FIGS. 23*a*-23*c* show typical high-resolution spectra of Fe2p measured from Samples 1-3, respectively.

The C1s spectrum of Sample 1, measured on the day of preparation, was curve-fitted with 6 components. In the case of Samples 2-3, the C1s spectrum was curve-fitted with 5 components. The binding energies (BE) and atomic concentrations (AC) of the various carbon species are quantified for Samples 1-3 in Table 4 hereinbelow.

TABLE 4

| | F | | E | | D | | C | | B | | A | |
|---|---|---|---|---|---|---|---|---|---|---|---|---|
| | AC (%) | BE (eV) | AC (%) | BE (eV) | AC (%) | BE (eV) | AC (%) | BE (eV) | AC (%) | BE (eV) | AC (%) | BE (eV) |
| SAMPLE 1 | 2.3 | 289.39 | 3.4 | 288.52 | 2.3 | 287.59 | 3.6 | 286.61 | 8.7 | 285.67 | 41.7 | 285.02 |
| SAMPLE 2 | — | — | 8.5 | 288.82 | 3.5 | 287.97 | 4.3 | 286.77 | 4.8 | 285.68 | 19.1 | 284.97 |
| SAMPLE 3 | — | — | 10.4 | 288.96 | 2.9 | 287.99 | 4.1 | 286.74 | 10.1 | 285.71 | 25.9 | 285.06 |

Binding energy line A, at 285.00 eV, is associated with carbon bound to hydrogen (irrespective of hybridization).

Higher binding energy lines B, C, D, E and F are assigned to different types of carbon-oxygen bonds.

The O1s and N1s spectra were curve-fitted with three and two components, respectively.

The Fe2p3/2 line was curve-fitted with five components. While binding energy line A, at 706.81 eV, can be related to metallic Fe originating from steel substrate, the higher binding energy lines can be assigned to Fe in different oxidation states. The presence of a metallic Fe line is due to the fact that the steel surface oxide and the carbon-rich overlayer are thin enough to allow the photoelectrons from the metal to escape through the oxide layer.

Figure 24A:
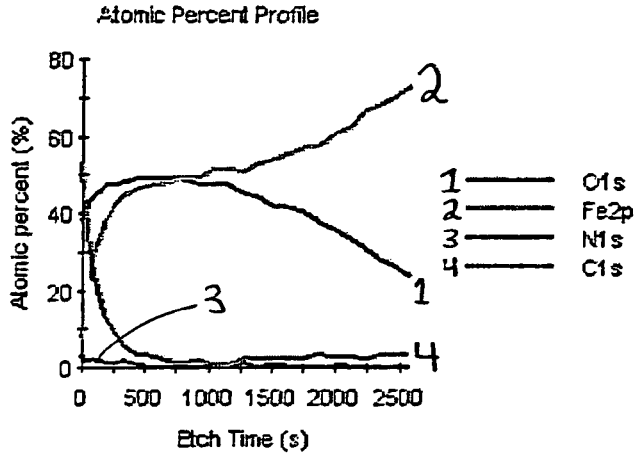
FIG. 24*a* is an XPS depth profile for an inventive (polymer) lapped steel sample, performed 10 weeks after preparation.
Figure 24B:
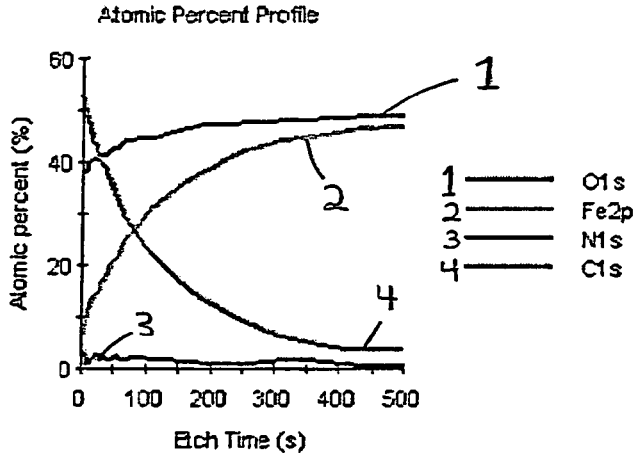
FIG. 24*b* is the same depth profile showing the first 500 seconds of the profiling.
Figure 25:
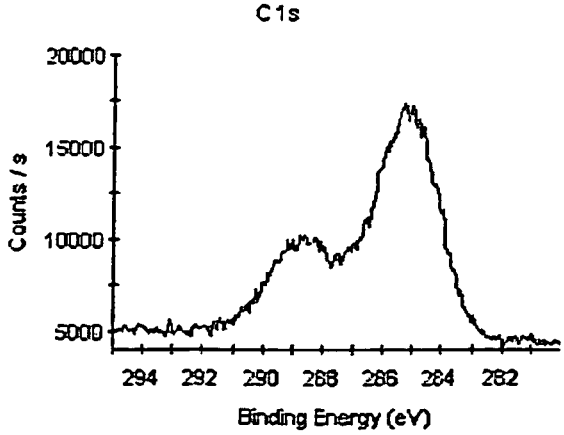
FIG. 25 is a plot showing the C1s line shape obtained during the depth profiling.

FIG. 24*a* is an XPS depth profile for an inventive (polymer) lapped steel sample, performed 10 weeks after preparation. The units of the profile are atomic concentration versus sputtering time. FIG. 24*b* is the same depth profile showing the first 500 seconds of the profiling. The XPS depth profile demonstrates the presence of a carbon-rich layer having a thickness of several nanometers, which covers, or at least partially covers, the oxidized steel surface. The C1s line shape (FIG. 25) obtained (with a pass energy of 100 eV) during the depth profiling is characterized by the presence of C—O bonds similar to some of those found for the polymeric contact surface.

Results and Conclusions of the Comparative Surface Analysis

- The steel sample lapped using the inventive polymeric lapping surface was analyzed on the day of preparation and after storage in a clean box for different periods of time: in all the samples, ~0.5% of nitrogen was found to be present at the sample surface.
- In the sample measured on the day of preparation, ~62% of carbon was found at the surface. Most of the carbon bonds were identified as C—H.
- After a day of storage in air, there was a decrease in the total amount of carbon identified on the sample surface. This phenomenon is accompanied by a decrease in the amount of the carbon-hydrogen bonds and a significant increase in the number of carbon-oxygen bonds characterized by a binding energy of ~288.8 eV.
- After additional storage of the samples, no significant change in the distribution of carbon-oxygen bonds was identified.
- Along with the change in the concentration of carbon and in the bonding states of carbon, a reduction in the amount of unoxidized iron was found, accompanied by an increase in the amount of oxidized iron. This signifies an increase in the thickness of the iron oxide layer attached to the metal underlayer.
- There is evidence from the XPS analysis results that during the storage, a chemical reaction occurred between the inventive polymeric lapping surface and the steel substrate, leading to the formation of a thicker interfacial metal oxide.
- For the sample stored for about 10 weeks, the thickness of the iron oxide was estimated to be approximately 6 nm, based on the XPS depth profiling results.
- Based on the XPS analysis, an organic-based material having an average thickness of several nanometers was found to be present on the surface of the polymer-lapped steel working surface of the present invention.
- The chemical composition of this organic material stabilizes after about one day (and sometimes several days or more) of storage in an oxygen-rich environment such as ambient air, and is characterized by the presence of a number of carbon-oxygen based fragments that are similar to, or substantially identical to, some of those found in the inventive polymeric lapping surface. Thus, aging the working surface prior to use advantageously changes the chemical and mechanical properties of the working surface.

Although the invention has been described in conjunction with specific embodiments thereof, it is evident that many alternatives, modifications and variations will be apparent to those skilled in the art. All publications mentioned in this specification are herein incorporated in their entirety by reference into the specification, to the same extent as if each individual publication was specifically and individually indicated to be incorporated herein by reference.

What is claimed is:

1. A conditioning process comprising the steps of:

(a) providing a system including:

(i) a workpiece having a metal working surface;

(ii) a contact surface, disposed generally opposite said working surface, said contact surface including an organic, polymeric material and (iii) a plurality of particles, including abrasive particles, said plurality of particles disposed between said contact surface and said working surface, and (b) treating said workpiece so as to:

(i) effect an at least partially elastic interaction between said contact surface and said abrasive particles such that at least a portion of said abrasive particles penetrate said working surface, and (ii) incorporate organic particles into said metal working surface, thereby producing a modified working surface, wherein said treating of said workpiece includes a lapping process including:

(i) exerting a load on said contact surface and said metal working surface, and (ii) applying a relative motion between said metal working surface and said contact surface;

and wherein said treating further includes aging said modified metal working surface in an oxygen-rich environment such that said organic particles are incorporated in said metal working surface.

2. The conditioning process of claim 1, wherein said treating further includes aging said modified metal working surface such that said organic particles intimately bond to said metal working surface.

3. The conditioning process of claim 1, further comprising the step of:

(c) producing at least one recessed microstructure in said metal working surface.

4. The conditioning process of claim 1, wherein said contact surface has a Shore D hardness within a range of 60 to 90.

5. The conditioning process of claim 1, wherein said contact surface has a Shore D hardness within a range of 65-90, and where in said impact resistance is within a range of 4 to 12 $kJ/m^2$.

6. The conditioning process of claim 5, wherein said impact resistance is within a range of 5 to 8 $kJ/m^2$.

7. The conditioning process of claim 5, wherein said Shore D hardness is within a range of 65 to 82.

8. The conditioning process of claim 5, wherein said Shore D hardness is within a range of 70-80.

9. The conditioning process of claim 1, wherein said organic particles are derived from said organic material on said contact surface.

10. The conditioning process of claim 1, wherein said treating is effected so as to incorporate at least a portion of said abrasive particles in said working surface.

11. The workpiece having said modified working surface, prepared according to the process of claim 1.

12. The workpiece having said modified working surface, prepared according to the process of claim 9.

13. The workpiece having said modified working surface, prepared according to the process of claim 10.

14. A conditioning process comprising the steps of:

(a) providing a system including:

a workpiece having a metal working surface;

(ii) a contact surface, disposed generally opposite said working surface, said contact surface including an organic, polymeric material and (iii) a plurality of particles, including abrasive particles, said plurality of particles disposed between said contact surface and said working surface, and (b) treating said workpiece so as to:

(i) effect an at least partially elastic interaction between said contact surface and said abrasive particles such that at least a portion of said abrasive particles penetrate said working surface, and (ii) incorporate organic particles into said metal working surface, thereby producing a modified working surface, wherein said treating of said workpiece includes a lapping process including:

(i) exerting a load on said contact surface and said metal working surface, and (ii) applying a relative motion between said metal working surface and said contact surface, and wherein said treating of said workpiece further includes aging said modified metal working surface in an oxygen-rich environment such that said organic particles are incorporated in said metal working surface.

15. The conditioning process of claim 14, wherein said conditioning is effected so as to incorporate at least a portion of said abrasive particles in said working surface.

16. The conditioning process of claim 14, wherein at least a portion of said organic particles is derived from said organic, polymeric material on said contact surface.

17. The workpiece having said metal working surface, prepared according to the process of claim 14.

18. A conditioning process comprising the steps of:

(a) providing a system including:

(i)a workpiece having a metal working surface;

(ii) a contact surface, disposed generally opposite said working surface, said contact surface including an organic, polymeric material and (iii) a plurality of particles, including abrasive particles, said plurality of particles disposed between said contact surface and said working surface, and (b) treating said workpiece so as to:

(i) effect an at least partially elastic interaction between said contact surface and said abrasive particles such that at least a portion of said abrasive particles penetrate said working surface, and (ii) incorporate organic particles into said metal working surface, thereby producing a modified working surface, wherein said treating of said workpiece includes a lapping process including:

(i) exerting a load on said contact surface and said metal working surface, and (ii) applying a relative motion between said metal working surface and said contact surface, and wherein said treating of said workpiece further includes aging said modified metal working surface so as to increase a ratio of polar bonds to non-polar bonds in said working surface, such that said organic particles are incorporated in said metal working surface.

* * * * *

UNITED STATES PATENT AND TRADEMARK OFFICE

CERTIFICATE OF CORRECTION

PATENT NO. : 7,918,713 B2
APPLICATION NO. : 11/651479
DATED : April 5, 2011
INVENTOR(S) : Kostia Mandel et al.

It is certified that error appears in the above-identified patent and that said Letters Patent is hereby corrected as shown below:

Title Page, Item (73)
Assignee should be corrected as follows:
Change:
-- Frisco --
to
"Fricso"

Title Page, Item (73)
Assignee's address should be corrected as follows:
Change:
-- Hakarhel --
to
"Hakarmel"

Column 31
Claim 14, line 9 should be corrected as follows:
Insert -- (i) -- at the beginning of the line before the word "a workpiece"

Signed and Sealed this
Twenty-eighth Day of June, 2011

David J. Kappos

David J. Kappos
*Director of the United States Patent and Trademark Office*